US009956564B2

(12) United States Patent
Rogers et al.

(10) Patent No.: US 9,956,564 B2
(45) Date of Patent: May 1, 2018

(54) WORKFLOW SUPPORT FOR ZONAL CENTRIFUGATION

(71) Applicant: BECKMAN COULTER, INC., Brea, CA (US)

(72) Inventors: Brian A. Rogers, Carmel, IN (US); Larry McIntyre, Carmel, IN (US); Gerald R. Kowalski, Lake Forest, CA (US); Tom Nguyen, Hacienda Heights, CA (US)

(73) Assignee: Beckman Coulter, Inc., Brea, CA (US)

( * ) Notice: Subject to any disclaimer, the term of this patent is extended or adjusted under 35 U.S.C. 154(b) by 102 days.

(21) Appl. No.: 14/346,452

(22) PCT Filed: Sep. 21, 2012

(86) PCT No.: PCT/US2012/056670

§ 371 (c)(1),
(2) Date: Mar. 21, 2014

(87) PCT Pub. No.: WO2013/044101

PCT Pub. Date: Mar. 28, 2013

(65) Prior Publication Data

US 2014/0235421 A1 Aug. 21, 2014

Related U.S. Application Data

(60) Provisional application No. 61/537,458, filed on Sep. 21, 2011.

(51) Int. Cl.

| | |
|---|---|
| ***B04B 5/04*** | (2006.01) |
| ***B04B 7/06*** | (2006.01) |
| ***B04B 13/00*** | (2006.01) |

(52) U.S. Cl.

CPC ..... *B04B 13/003* (2013.01); *B04B 5/0442* (2013.01); *B04B 7/06* (2013.01); *B04B 13/00* (2013.01); *B04B 2013/006* (2013.01)

(58) Field of Classification Search

CPC . B04B 13/00; B04B 13/003; B04B 2013/006; B04B 1/02; B04B 5/0442;

(Continued)

(56) References Cited

U.S. PATENT DOCUMENTS 4,209,176 A 6/1980 Soodak et al.
5,581,687 A * 12/1996 Lyle ..... G06F 19/3406 715/792

(Continued)

FOREIGN PATENT DOCUMENTS

CN 2644002 Y 9/2004
CN 101222981 A 7/2008

(Continued)

OTHER PUBLICATIONS

International Search Report and Written Opinion for International Application No. PCT/US2012/056670 dated May 23, 2013 (16 pages).

(Continued)

*Primary Examiner* — Walter D Griffin
*Assistant Examiner* — Shirley S Liu
(74) *Attorney, Agent, or Firm* — Merchant & Gould P.C.

(57) ABSTRACT

A centrifuge device displays a workflow diagram during operation. The workflow diagram includes a loading step-indicator, a running step-indicator, and an unloading step-indicator. The loading step-indicator is displayed when the centrifuge device is operating in a loading mode. The running step-indicator is displayed when the centrifuge device is operating in a running mode. The unloading step-indicator is displayed when the centrifuge device is operating in the unloading mode. A centrifuge system includes the centrifuge device and a handheld device operable remote from the centrifuge device, which displays a (Continued)

status of the centrifuge device. Methods of operating a centrifuge device and a centrifuge system are also disclosed.

20 Claims, 20 Drawing Sheets

(58) Field of Classification Search
CPC ..... B04B 7/06; B04B 11/04; B04B 11/043; B04B 2011/046
USPC ..... 494/10, 12, 37, 84
See application file for complete search history.

(56) References Cited

U.S. PATENT DOCUMENTS 5,653,887 A * 8/1997 Wahl ..... A61M 1/3624 210/745
2010/0081553 A1* 4/2010 Aizawa ..... B04B 5/0442 494/14
2010/0138031 A1* 6/2010 Werfeli ..... G05B 19/409 700/200
2011/0047135 A1 2/2011 Vizethann et al.
2011/0165023 A1 7/2011 Eble

FOREIGN PATENT DOCUMENTS

CN 101460254 A 6/2009
WO 2009102743 A2 8/2009
WO WO 2009102743 A2 * 8/2009 ..... B04B 7/02
WO 2011042426 A1 4/2011

OTHER PUBLICATIONS

European Patent Office, European Search Report for application No. 14003774.8, dated Feb. 17, 2015, 7 pages.
State Intellectual Property Office of the People's Republic of China, The Second Office Action for Application No. 201280046140.1, dated Mar. 24, 2016, 8 pages.
State Intellectual Property Office of the People's Republic of China, The Second Office Action for Application No. 201280046140.1, dated Jul. 17, 2015, 8 pages.

* cited by examiner

WORKFLOW SUPPORT FOR ZONAL CENTRIFUGATION

CROSS REFERENCE TO RELATED APPLICATIONS

This application is being filed on 21 Mar. 2014, as a US National Stage of PCT International Patent application No. PCT/US2012/056670, filed 21 Sep. 2012 in the name of Beckman Coulter, Inc., a U.S. national corporation, applicant for the designation of all countries except the U.S., and, Brian A. Rogers, a citizen of U.S., Larry McIntyre, a citizen of the U.S., Gerald R. Kowalski, a citizen of the U.S., and Tom Nguyen, a citizen of the U.S., applicants for the designation of the U.S. only, and claims priority to U.S. Patent Application Ser. No. 61/537,458 filed on 21 Sep. 2011 and which applications are incorporated herein by reference. To the extent appropriate, a claim of priority is made to each of the above disclosed applications.

BACKGROUND

Centrifugation is a process commonly used to separate particles in a sample for isolation or analysis of the particles. In a conventional centrifugation operation, sample tubes or bottles are placed in a rotor, and the centrifuge spins the rotor at a desired rotational speed (rotor speed) in an enclosed chamber. As a safety feature, some centrifuges include a door to the chamber and a latch that secures the door in a closed position during the centrifugation operation. Some centrifuges also include a safety switch that prevents the centrifuge from spinning the rotor when the door is unlocked. These features help prevent exposure of lab personnel to the physical hazards of a spinning rotor.

Some centrifugation operations, however, require a user to access and work on a spinning rotor. For example, a zonal centrifugation operation includes performing manual tasks on a spinning rotor. During the loading step of the operation, a sample is loaded onto a density gradient. This step involves the user to deliver the sample into the rotor and install/remove the fill apparatus while the rotor is spinning. The rotor speed is then increased to a running speed, where the desired particle separation through the density gradient is achieved under vacuum. Finally, the rotor speed is reduced to an unloading speed, the fill apparatus is manually re-installed onto the rotor, and the separated sample is unloaded while the rotor spins. To accomplish the loading and unloading steps, safety features, such as the safety switch or door latch described above, must be deactivated. Consequently, the user is exposed to the risk of injury from the spinning rotor or leaking sample during operations like zonal centrifugation operation.

Workflow in a laboratory can be disrupted if a centrifuge malfunctions; but an instrument cannot be under constant observation. For example, there may be a number of centrifuges located throughout a laboratory, a building, or a campus. Also, some centrifugation operations, like isolation of high-purity plasmid DNA, may take hours to complete. So, a user may or may need to leave a centrifuge unattended for some time. Therefore, laboratory users, technicians, scientists and supervisors desire functionalities that monitor and/or provide diagnostic information about these instruments to ensure that operation is proceeding safely, and if necessary, to take action.

Accordingly, it is an object of the present invention to provide improved methods, apparatus, and systems to address the problems described above.

SUMMARY

In general terms, this disclosure is directed to workflow support for zonal centrifugation.

One aspect is a method of operating a centrifuge, the method comprising: displaying a workflow diagram of a centrifuge operation, the workflow diagram including at least a loading step-indicator, a running step-indicator, and an unloading step-indicator; receiving sample into a rotor of the centrifuge while the loading step-indicator is highlighted and while the rotor is spinning at a first speed; spinning the rotor at a second speed while the running step-indicator is highlighted; and unloading sample from the rotor while the unloading step-indicator is highlighted and while the rotor is spinning at a third speed.

Another aspect is a centrifuge device for performing a zonal centrifugation operation, the centrifuge device comprising: a zonal rotor having a cavity, the zonal rotor configured to receive a sample onto a density gradient contained in the cavity; a display device adapted to display a user interface; and a processing device adapted to: control a rotation of the zonal rotor to operate the zonal rotor in a loading mode, a running mode, and an unloading mode; and generate a user interface with the display device, the user interface displaying a loading step-indicator when the zonal rotor is operating in the loading mode, a running step-indicator when the zonal rotor is operating in the running mode, and an unloading mode when the zonal rotor is operating in the unloading mode.

A centrifuge system comprising: a centrifuge device including: a chamber; a rotor disposed in the chamber; a display device; and a processing device, wherein the processing device operates to generate a user interface on the display device identifying a status of the centrifuge device; and a handheld computing device in data communication with the centrifuge device, the handheld device including: a handheld display device; and a handheld processing device that operates to generate a handheld user interface on the handheld display device identifying the status of the centrifuge device.

A further aspect is a method of performing a zonal centrifugation operation, the method comprising the steps of: indicating, on a screen of a centrifuge, that a loading step is the current step of the zonal centrifugation operation; delivering, while a zonal rotor is spinning, a sample onto a density gradient in the zonal rotor; and indicating, on the screen of the centrifuge after the loading step is complete, that a running step is the current step of the zonal centrifugation operation.

Another aspect is a centrifuge device for performing a zonal centrifugation operation, the centrifuge device comprising: a screen adapted to indicate the current step of the zonal centrifugation operation; a zonal rotor having a cavity, the zonal rotor configured to receive a sample onto a density gradient contained in the cavity; and a processor in communication with the screen, the processor adapted to control the rotation of the zonal rotor, the processor further adapted to display, on the screen, a step-indicator corresponding to the current step of the zonal centrifugation operation.

A further aspect is a centrifuge device for performing a first and second centrifugation operations, the centrifuge device comprising: a processor adapted to control the action of the centrifuge device during the first and second centrifugation operations based on the value of one or more centrifugation parameters; a local user interface communicatively connected to the processor, the local user interface adapted to receive values, entered by a local user, for one or more of the centrifugation parameters; and a remote user interface communicatively connected to the processor, the remote user interface adapted to receive values, entered by a remote user, for one or more of the centrifugation parameters, wherein, the processor is further adapted to limit the number of centrifugation parameters for which a remote user may enter a value to control the action of the centrifuge during the second centrifugation operation.

Another aspect is a centrifuge system comprising: a local user interface adapted to receive commands entered by a user to control the action of a centrifuge; a remote device including a remote user interface, the remote user interface adapted to receive commands entered by a user to control the action of the centrifuge; a processor adapted to limit the control of the action of the centrifuge from the remote device based on a mode of operation of the centrifuge.

Another aspect is a method of operating a centrifuge, the method comprising; displaying a workflow diagram of a centrifuge operation, the workflow diagram including a step-indicator of loading sample into a zonal rotor; loading sample into a rotor while the rotor is spinning at a first speed; indicating completion of the step of loading sample; and increasing rotor spinning speed to a second speed.

A further aspect is a method of operating a centrifuge, the method comprising: displaying a workflow diagram of a centrifuge operation, the workflow diagram including a loading step-indicator, a running step-indicator, and an unloading step-indicator; loading sample into a rotor while the loading step-indicator is highlighted and while the rotor is spinning at a first speed; spinning the rotor at a second speed while the running step-indicator is highlighted; and unloading sample from the rotor while the unloading step-indicator is highlighted and while the rotor is spinning at a third speed.

BRIEF DESCRIPTION OF THE DRAWINGS

FIG. 7 depicts a homepage of an example centrifuge after a successful log-in.

DETAILED DESCRIPTION

Figure 1:
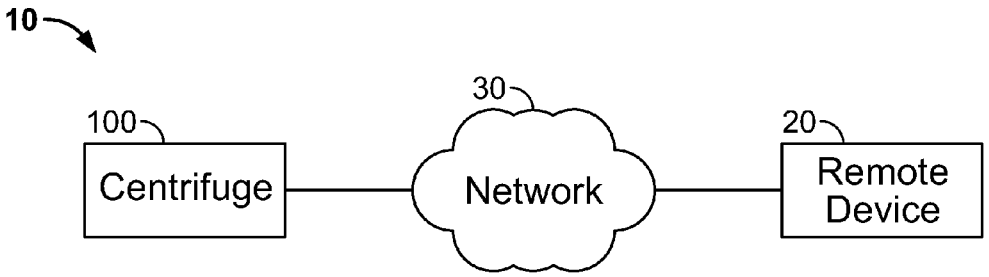
FIG. 1 is a black diagram illustrating a possible embodiment of a centrifuge system.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
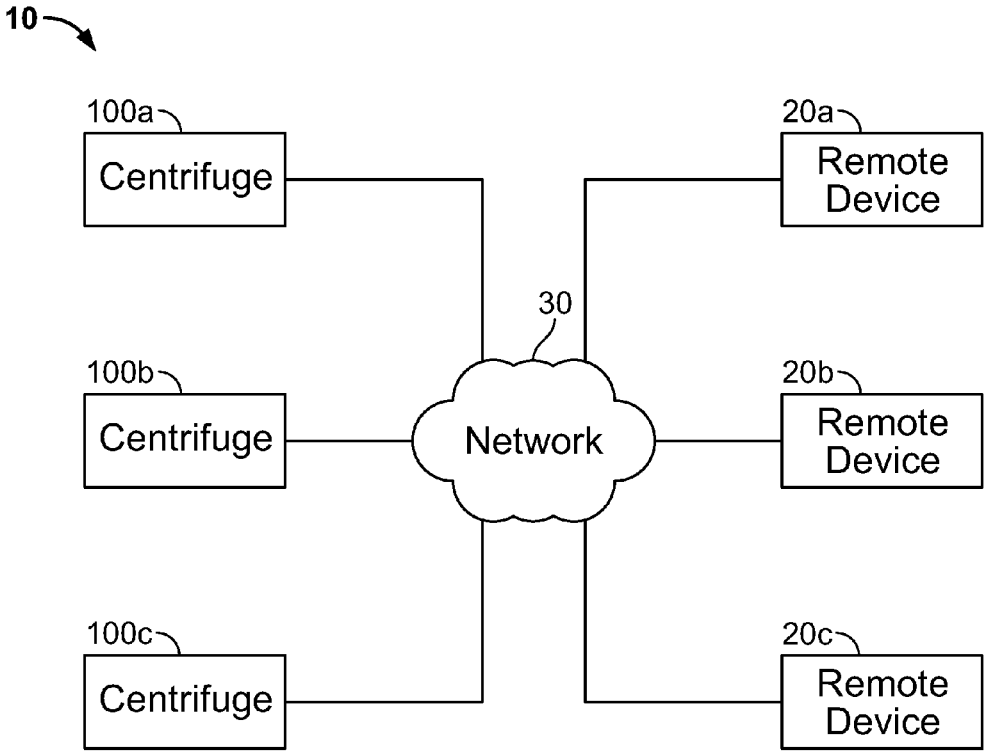
FIG. 2 is a block diagram illustrating a possible embodiment of a centrifuge system.
Figure 3:
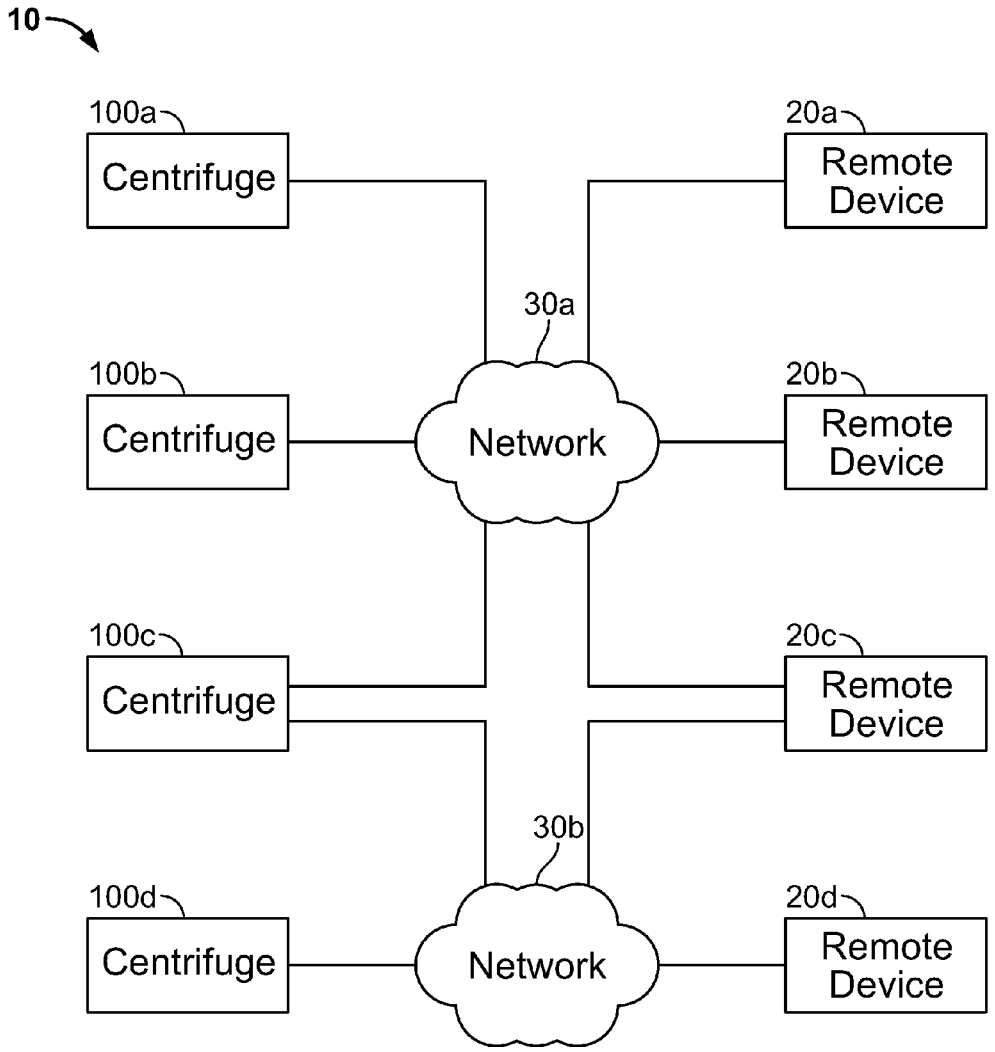
FIG. 3 is a block diagram illustrating a possible embodiment of a centrifuge system.

FIGS. 1-3 are block diagrams illustrating various possible embodiments of a centrifuge system 10. FIG. 1 shows a centrifuge system 10 including a centrifuge 100 and a remote device 20. The remote device 20 is communicatively coupled to the centrifuge 100 over a network 30.

FIG. 2 shows multiple remote devices 20*a*, 20*b*, 20*c* communicatively coupled to multiple centrifuges 100*a*, 100*b*, 100*c* over a network 30. Although the centrifuge system 10 may be configured as shown, not every remote device need be coupled to every centrifuge. Whether a particular remote device is permitted to connect to a particular centrifuge may be based on entering an authorized user information, such as username and personal identification number, which will be discussed later. Consequently, any combination of component connection is possible. For example, remote device 20*a* may be communicatively coupled to centrifuges 100*a* and 100*b*; while remote device

20*b* may be coupled to 100*b*, and 100*c*. Also, multiple remote devices 20*b* and 20*c* may be connected to a single centrifuge 100*c*.

FIG. 3 shows a centrifuge system 10 with two networks 30*a* and 30*b*. In this embodiment, remote device 20*c* may be coupled to centrifuge 100*a* via network 30*a*, and also be coupled to centrifuge 100*d* via network 30*b*. Also, centrifuge 100*c* may be coupled to remote device 20*b* via network 30*a*, and also be coupled to remote device 20*d* via network 30*b*.

Preferably, the remote device 20, 20*a*, 20*b*, 20*c*, 20*d* is a wireless handheld device, such as an iPhone or iPad, that connects to a centrifuge 100, 100*a*, 100*b*, 100*c*, 100*d* via the network by an enabling technology, such as Wi-Fi. Network connection can also be achieved by an Ethernet connection, a modem, or other connectivity device. The network 30, 30*a*, 30*b* may be a local or wide area network, internet, intranet, wireless network, a cellular network, telecom, phone system, digital or analog signal transmission system, or other suitable communication systems that allows sharing and/or transmitting information and services. To facilitate interaction between software on the centrifuge 100 and the remote device 20, an application programming interface (API) may be required.

Figure 4:
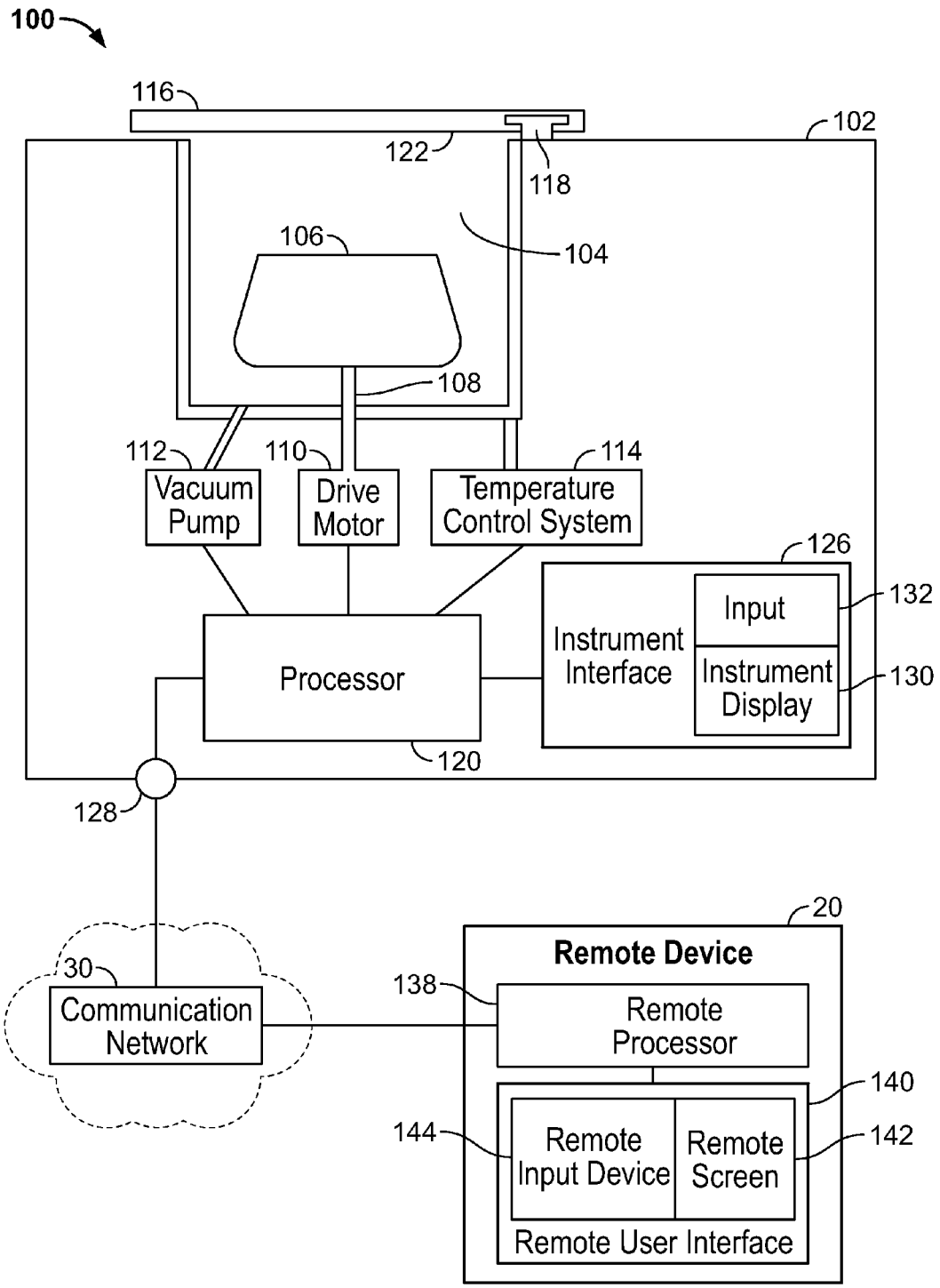
FIG. 4 is a schematic block diagram of an example centrifuge according to the present disclosure.

FIG. 4 is a schematic block diagram of an example centrifuge 100. In a typical centrifugation operation, the centrifuge 100 generates centrifugal forces to separate particles in a sample. In the illustrated embodiment, the centrifuge 100 includes a housing 102, a rotor chamber 104, a rotor 106, a drive shaft 108, a motor 110, a processor 120, and an instrument interface 126.

The housing 102 protects and encloses at least some components of the centrifuge 100. The rotor 106 holds samples to be separated, and is arranged in the rotor chamber 104. The rotor chamber 104 defines an interior space in which the rotor 106 spins. In the illustrated example, an opening 122 on top of the rotor chamber 104 provides a user access to the rotor 106. A door 116 covers the opening 122, and a latch 118 secures the door 116 in place. Preferably, the door 116 and the rotor chamber 104 are reinforced to contain energy and debris that may be released in the event of a rotor failure.

The drive shaft 108 extends into the rotor chamber 104 and releasably connects to the rotor 106. The releasable connection permits the rotor 106 to be removed from the rotor chamber 104 and facilitates the use of a different configuration rotor as desired. The motor 110 connects to the drive shaft 108 and rotates the rotor 106 at a desired speed that may be defined by a user. An example of a motor 110 is an AC induction motor, or other suitable drive mechanisms including, for example, switched reluctance drives.

A vacuum pump 112 is provided in some embodiments to adjust the atmospheric pressure within the rotor chamber 104. The vacuum pump 112 is coupled to the rotor chamber 104 through a hose, tube, pipe, or the like, to withdraw air from the rotor chamber 104. A temperature control system 114 is provided in some embodiments to control the temperature within the rotor chamber 104. The temperature control system 114 may comprise of an array of thermoelectric modules surrounding the rotor chamber 104. Alternatively, the temperature control system 114 may comprise of a cooling motor that pumps a refrigerant through coils surrounding the rotor chamber 104.

Among other things, the processor 120 controls the various centrifuge components including the operation of the motor 110, the vacuum pump 112, the temperature control system 114, and latch 118. The processor 120 also manages the information and graphics displayed on the instrument interface 126. The processor 120 is typically communicatively coupled to one or more computer readable storage media, such as a memory storage device. In some embodiments, the computer readable storage media may encode data instructions. When the data instructions are processed by the processor 120, the instructions cause the processor 120 to perform one or more of the actions, operations, methods, or functions described herein, or to interact with one or more of the other components of the centrifuge 100 to perform the actions, operations, methods, or functions.

Processor 120 may be one or more processing devices including a microprocessor, a microcontroller, a computer, or other suitable devices that control operation of devices and execute programs. Various other processor devices may also be used including central processing units ("CPUs"), microcontrollers, programmable logic devices, field programmable gate arrays, digital signal processing ("DSP") devices, and the like. Processor 120 may include any general variety device such as a reduced instruction set computing ("RISC") device, a complex instruction set computing ("CISC") device, or a specially designed processing device such as an application-specific integrated circuit ("ASIC") device.

The instrument interface 126 of centrifuge 100 is provided to interact with a user. The instrument interface 126 may be part of the centrifuge console, or it may be an external device connected to the centrifuge 100, such as a personal computer. In the disclosed embodiment, the instrument interface 126 includes an instrument display 130 and one or more input interfaces 132. The instrument display 130 can be any display device, such as a computer monitor or a video screen. The input interface 132 can be any information entering device such as a keyboard, mouse, or a touch pad. In some embodiments, the instrument display 130 and the input interface 132 are combined in a touch-sensitive display.

Parameters of a centrifugation operation include rotor chamber temperature, rotor speed, and rotor run time. The rotor speed is the rotational speed of the rotor 106 during the centrifugation operation, and run time is the duration that the rotor 106 spins at the rotor speed. A preset parameter is a value that the centrifuge 100 is prepared to apply. This may be a default value, a value from a previous centrifuge operation, a value that is entered or modified by a user through the input interface 132, or a programmed value. The processor 120 displays the preset parameter on the instrument display 130. During a centrifugation operation, the processor 120 controls the motor 110 and the temperature control system 114 to spin the rotor 106 at the preset rotor speed for the preset run time at the preset temperature.

The centrifuge 100 may be adapted to operate in a conventional centrifugation mode or in a rotor-accessible centrifugation mode. In the conventional centrifugation mode, the centrifuge 100 performs centrifugation operations with the door 116 closed while the rotor 106 is spinning. In the rotor-accessible mode, the centrifugation operation includes at least one step where the door 116 is allowed to open while the rotor 106 is spinning to facilitate the user to access and work on the rotor 106. For example, during a zonal centrifugation operation, the user may install or remove a loading apparatus (such as a fill-head and a support shield) onto a spinning rotor to deliver and remove sample into and out of a zonal rotor.

The centrifugation mode of centrifuge 100 is selectable by the user. In one embodiment, the centrifuge 100 remains in the conventional mode by default, until a user selects the rotor-accessible mode. In this embodiment, the centrifuge 100 returns to conventional mode automatically when the centrifugation operation in the rotor-accessible mode ends. A user may select the mode of operation by operating a switch on the centrifuge 100. In another embodiment, the processor 120 prompts the user to select the centrifugation mode on the instrument display 130.

If the conventional mode is selected, the centrifuge 100 will be ready to run an entirely closed-chamber operation. Before or after selecting or entering the mode and/or operation parameters, samples typically contained in tubes or bottles are placed into the rotor 106. A cap may be placed over the rotor 106 to secure the sample containers in place during the centrifugation operation. The user activates the start button to begin the conventional operation. The processor 120 controls the necessary components to spin the rotor 106 according to the preset temperature, run speed and run time. After the preset run time has elapsed, the rotor 106 is decelerated to stop. The user may also activate a stop button to decelerate the rotor 106 before the preset run time has elapsed.

If the rotor-accessible mode (such as zonal centrifugation or continuous-flow mode) is selected, the centrifuge 100 will be ready to run an operation where user access to a spinning rotor 106 is selectively provided. Accordingly, the safety switch that prevents the motor 110 from spinning the rotor 106 if the door 116 is not closed will be deactivated for a select time. Similarly, the latch 118 that locks the door 116 closed while the rotor is spinning must also be deactivated for at least a period of time.

Rotor-accessible mode centrifugation operations are common in vaccine production and bioprocessing operations, where relatively large volumes are processed. A zonal centrifugation operation includes delivering sample onto a density gradient and into a zonal rotor while the rotor is spinning at a load speed, (generally between about 2,000 and 3,000 RPM). A continuous-flow centrifugation operation includes a step of delivering sample into a continuous-flow rotor while the rotor is spinning. The continuous-flow operation may include additional manual steps of checking wobble of the rotor, installing an adapter bowl and bearing housing, checking the centering of the adapter bowl and bearing housing, and installing a seal assembly and manifold.

Figure 5:
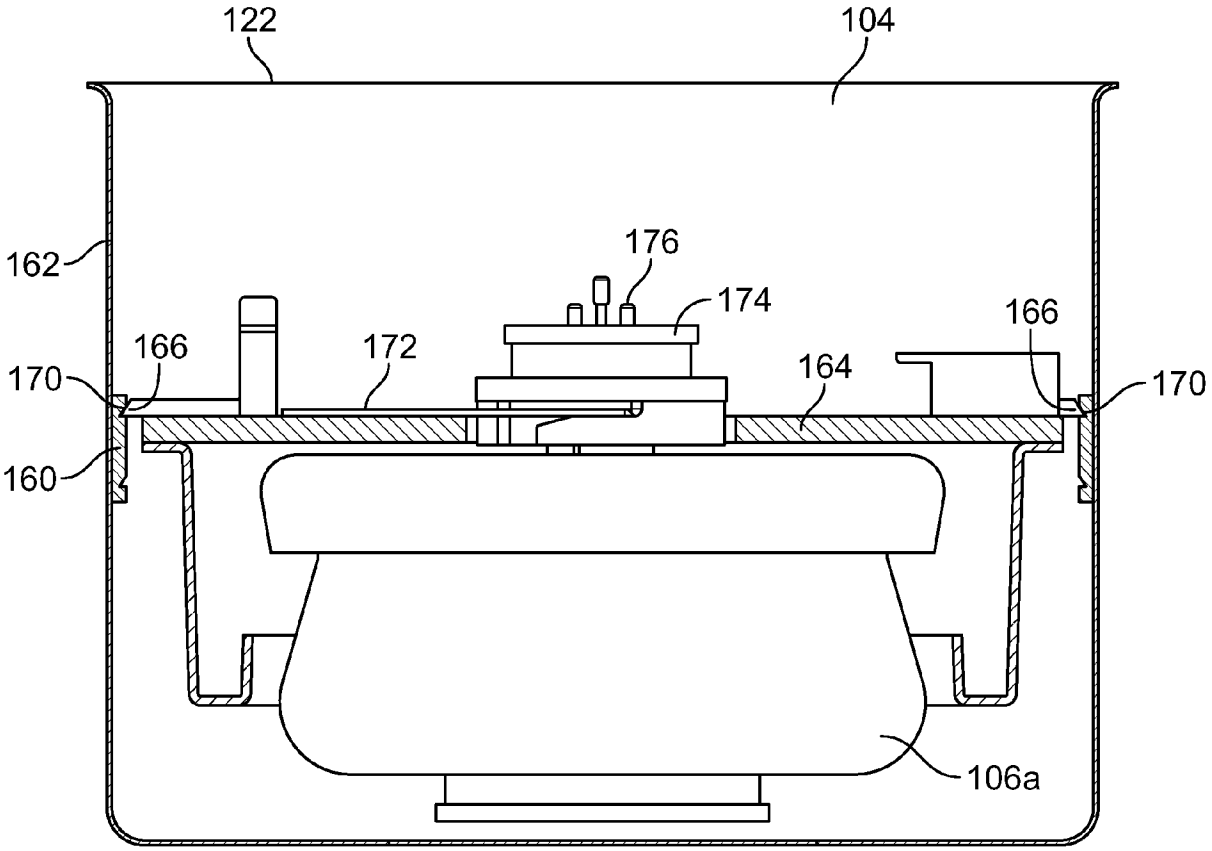
FIG. 5 is a graphical depiction of one embodiment of a centrifuge configuration during the loading step of a zonal centrifugation operation.

FIG. 5 is a graphical depiction of one embodiment of a centrifuge configuration during the loading step of a zonal centrifugation operation. A support band 160 is positioned on a side wall 162 of the rotor chamber 104. A support shield 164 is removably positioned above a zonal rotor 106*a* through engagement of tabs 166 on the support shield 164 with corresponding slots 170 in the support band 160. A bracket 172 attached to the support shield 164 supports and positions a sample fill head 174 above the zonal rotor 106*a*. Bearings in the rotor allow the introduction of sample through an access port 176 of the sample fill head 174 into the zonal rotor 106*a* while the zonal rotor 106*a* is spinning. In this loading configuration, the door 116 is open to allow the loading of the sample into the zonal rotor 106*a*.

As described above, centrifugation operations performed in the rotor-accessible mode includes at least one step that exposes a user to a spinning rotor in the rotor chamber 104. This makes the centrifugation operation inherently more dangerous than a conventional operation. To alert a user to the potential harm, the centrifuge 100 provides a visual indication that it is operating in the rotor-accessible mode. Moreover, centrifuge 100 may indicate which step of the centrifuge operation is the current step when the centrifuge is in the rotor-accessible mode. As a further safety feature, operation of the centrifuge 100 in rotor-accessible mode may be limited to authorized users who have been properly trained.

User interface aspects of the centrifuge 100 will now be described. In one embodiment, the centrifuge 100 may include user information, where each user may be assigned or registers a unique username and a password (PIN). In this way, the centrifuge 100 may verify that the user is authorized to access and operate the centrifuge 100.

Figure 6:
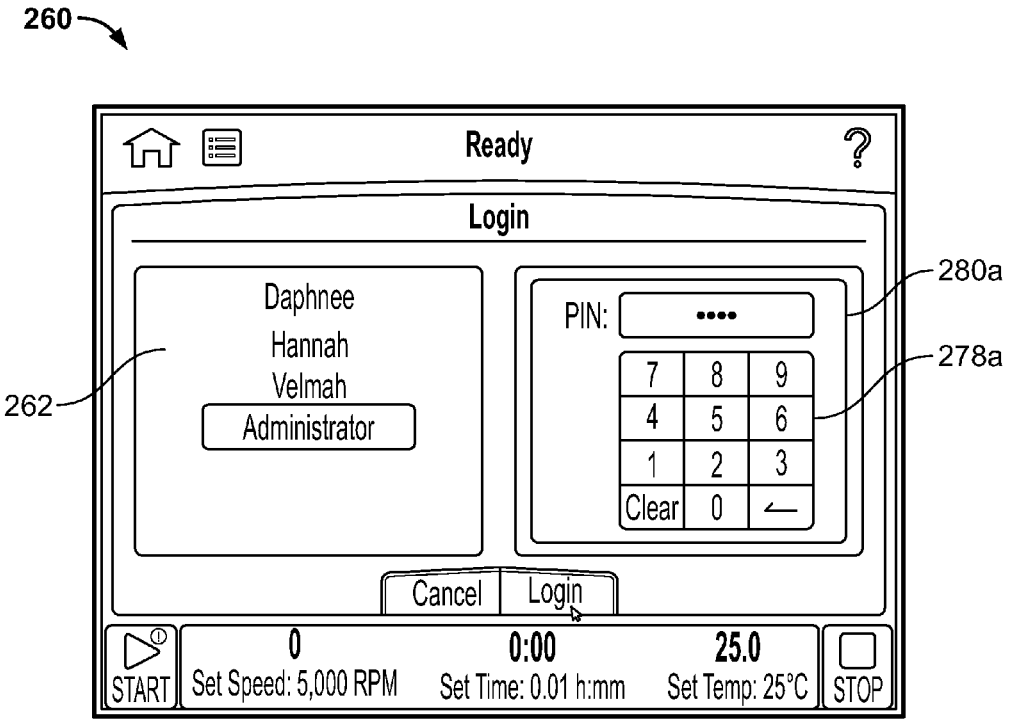
FIG. 6 depicts a log-in page of an example centrifuge.

FIG. 6 depicts a log-in page 260 displayed on the instrument display 130 of an example centrifuge 100 that prompts for the entry of a username and PIN. The username may be selected from a list 262, and the PIN is entered into the entry box 280*a* using the keypad 278*a*. If the PIN agrees with the PIN assigned to that username according to information stored in authorized user data, the processor allows the user access to the centrifuge, and displays the homepage 200*a* (FIG. 7).

In the illustrated embodiment, the username is selected from a list and a corresponding PIN is typed into a box. In other embodiments, an authorized user may be identified using a magnetic or visual identifier on an ID card or employee badge, a biomarker such as a thumbprint, an RFID, or the like.

In one embodiment, a username is associated with a level of access to the centrifuge 100. An administrator level may allow the user access to all the functions of the centrifuge 100. An intermediate level may allow the user to run all programs on the centrifuge 100, to run the centrifuge 100 manually, to manage users, to assign programs, to manage a rotor library, and to perform calculations and simulations on the centrifuge 100. A lower level of access may limit the user to running assigned programs. In one embodiment, the username must be associated with an intermediate (or higher) level of access in order for the user to access the rotor-accessible centrifugation mode. In another embodiment, access to the rotor-accessible mode is limited to a selected set of usernames.

Figure 7:
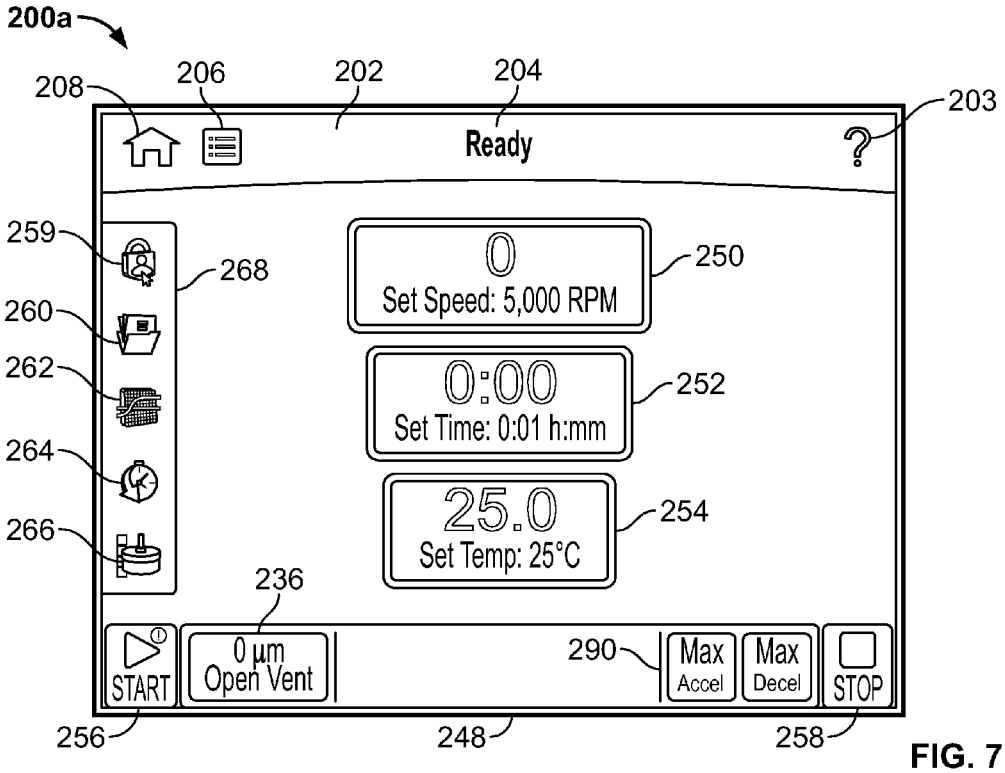

Referring to FIG. 7, the homepage 200*a* shows that the centrifuge 100 is ready in the conventional centrifugation mode. The homepage 200*a* summarizes the overall status of the centrifuge 100. In the illustrated embodiment, the homepage 200*a* displays preset centrifugation parameters that have been entered by the user for a centrifugation operation, as well as actual centrifugation parameters (the real-time values). The homepage 200*a* includes a status bar 202, a rotor-speed button 250, a run-time button 252, a temperature button 254, a side bar 268, and a footer bar 248.

Status bar 202 provides a visual indication of the operational state and condition of the centrifuge 100. It may indicate, for example, that no centrifugation operation has started or that a centrifugation operation is in progress. It may also indicate that an instrument error or malfunction has occurred. In one embodiment, the color of the status bar 202 indicates the operational state of the centrifuge 100. The color may be blue if the centrifuge has not begun a centrifugation operation (i.e. is idle), green if a centrifugation operation is in progress, yellow if a minor instrument malfunction has been detected, or red if a major instrument malfunction has been detected. These centrifuge condition information are derived from operation information produced by the centrifuge 100. Sensors monitor parameters and where any are detected to be out of range, for example, a yellow or red indication may be triggered. A major malfunction may be a detected condition that requires the centrifuge to cease centrifugation operations. Besides color, other visual indications of the status bar 202 may be used to indicate the operational state and condition of the centrifuge 100.

Figure 8:
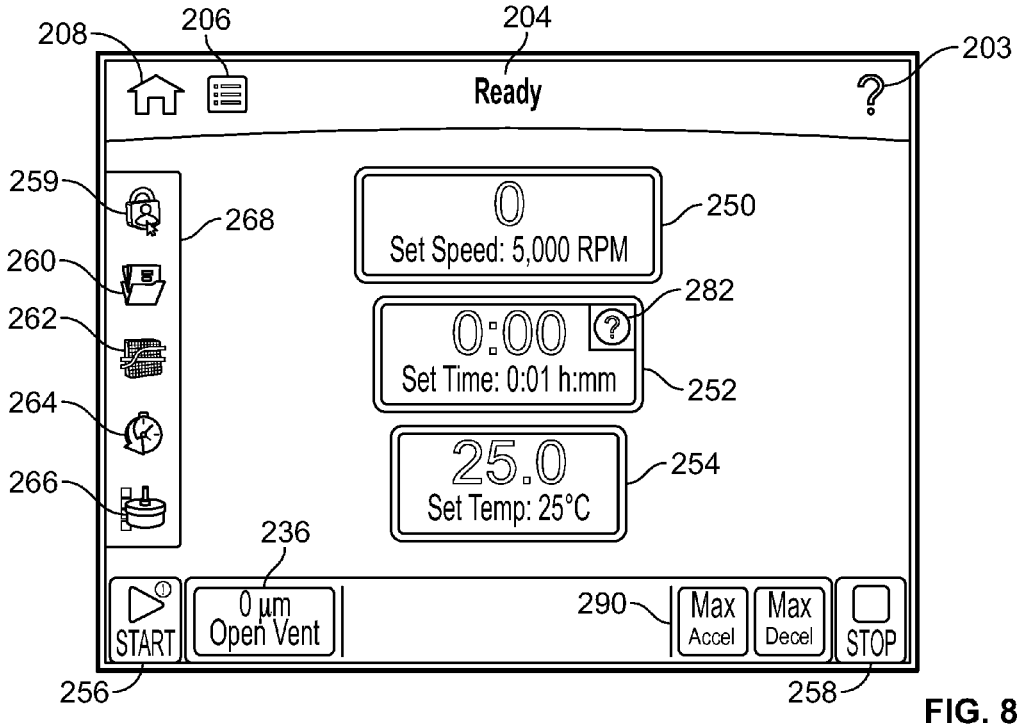
FIG. 8 depicts a help page of an example centrifuge.

Status bar 202 may also include a help button 203, a notice indicator 204, a menu button 206, and a home button 208. Help button 203 may provide access to a context-sensitive help system to guide the user in the operation of the centrifuge 100. In one embodiment, when help button 203 is selected, the centrifuge enters a help mode, where buttons and controls on a touch-sensitive screen are deactivated and a help icon 282 is displayed over those buttons and controls for which help information is available. (FIG. 8). Selecting a help icon 282 causes the centrifuge 100 to display a help message explaining the operation of that button or control.

Status bar 202 also includes notice indicator 204 to further guide the user in identifying the current state of operation of the centrifuge 100. For example, notice indicator 204 can inform the user that the centrifuge 100 is ready (no operation has started), running (an operation is in progress), or stopping (an operation is ending). In some embodiments, the notice indicator 204 is a text word that signifies an operational state of the centrifuge 100. In one embodiment, the status bar 202 may be green and the notice indicator 204 may be the text "running" to inform a user that a centrifugation operation is in progress and the rotor has not begun a final deceleration. The status bar 202 may then remain green and the notice indicator 204 change to "stopping" to indicate that the centrifugation operation is still in progress (the rotor 106 is still spinning) but the rotor 106 is decelerating to a final stop to end the operation. The notice indicator 204 may also indicate to the user that an instrument error has occurred during a centrifugation operation.

Status bar 202 includes a menu button 206. Selecting this button may bring up a menu of various functions and operations available to the user, allowing the user to select among the functions and operations.

Status bar 202 includes a home button 208 to select the homepage 200 corresponding to the current centrifugation operation.

Figure 9:
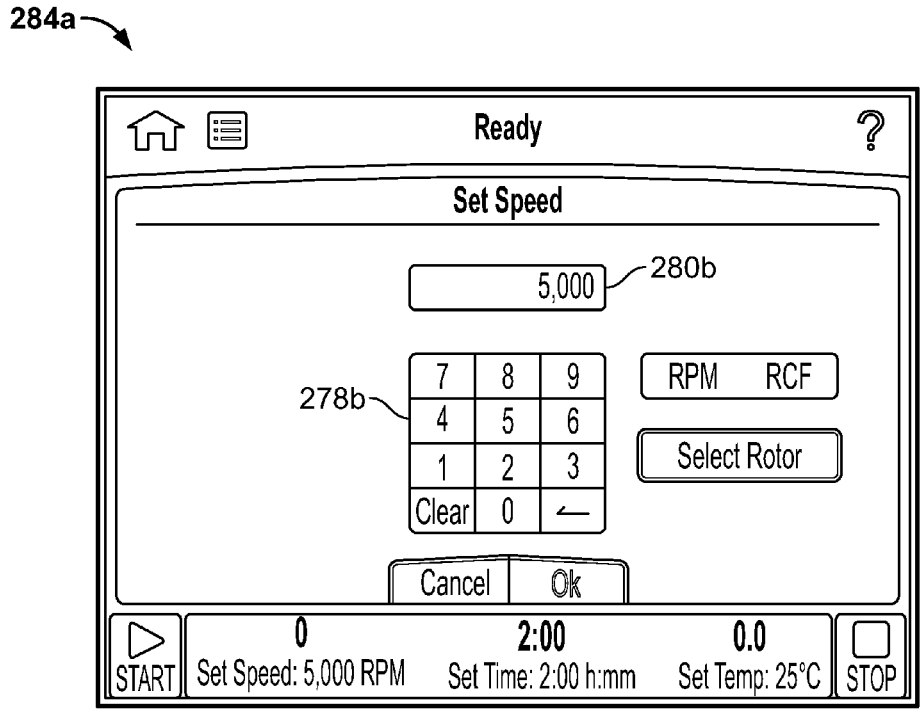
FIG. 9 depicts an input page for a preset rotor speed of an example centrifuge.

The rotor-speed button 250 displays both the preset rotor speed (for the next centrifugation operation) and the actual (current) rotor speed. Selecting this button causes an input page 284*a* to be displayed, prompting the user to enter the preset rotor speed for a centrifugation operation into an entry box 280*b* using a keypad 278*b* (FIG. 9).

Figure 10:
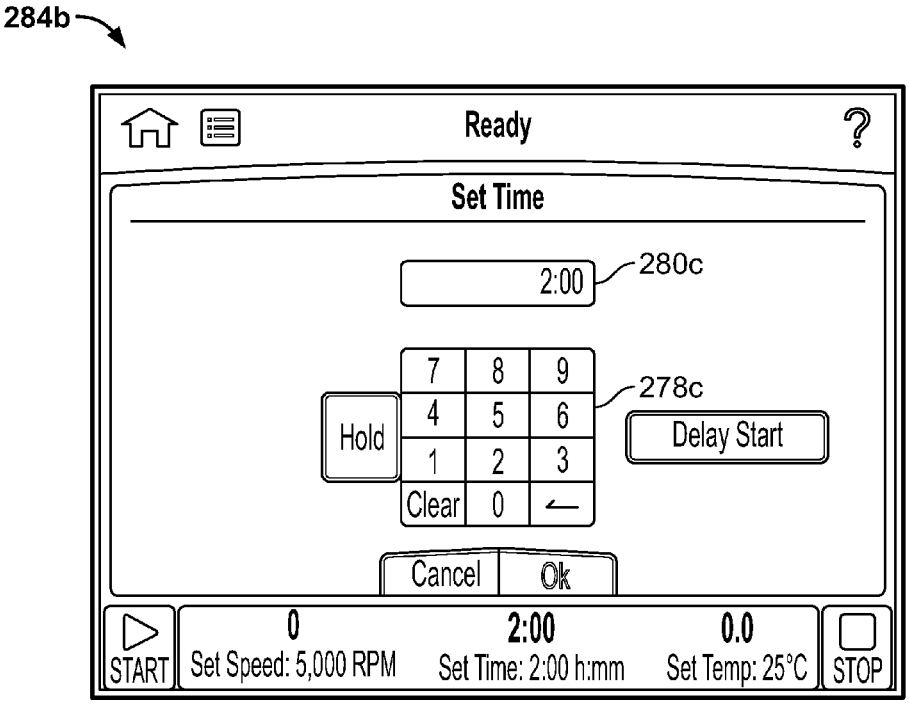
FIG. 10 depicts an input page for a preset run time of an example centrifuge.
Figure 11:
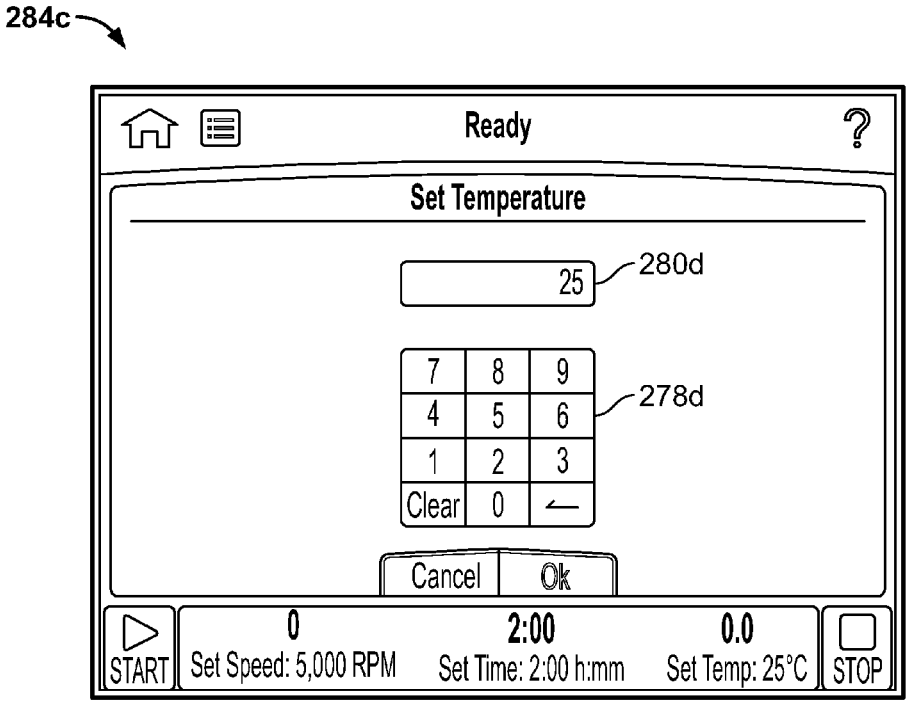
FIG. 11 depicts an input page for a temperature of an example centrifuge.

Likewise, run-time button 252 displays both the preset run time and the actual time remaining in a run, and allows a user to enter the preset run time on an input page 284*b* in an entry box 280*c* using a keypad 278*c* (FIG. 10). Similarly, temperature button 254 displays both the preset and actual temperature of the rotor chamber 104, and allows a user to enter the preset temperature on an input page 284*c* using keypad 278*d* (FIG. 11).

As shown in FIG. 7, footer bar 248 includes start button 256, stop button 258, vacuum button 236, and acceleration/deceleration button 290. In one embodiment, when the start button 256 is selected, the motor 110 accelerates the rotor 106 to the preset rotor speed, and notice indicator 204 changes from 'Ready' to 'Running' to signify that a centrifugation operation has begun. Selecting the stop button 258 causes the centrifuge 100 to decelerate the rotor 106 to zero RPM to end the centrifugation operation.

Vacuum button 236 displays the atmospheric pressure inside the rotor chamber 104, and serves as a toggle switch to apply or release a vacuum inside the rotor chamber 104.

Figure 12:
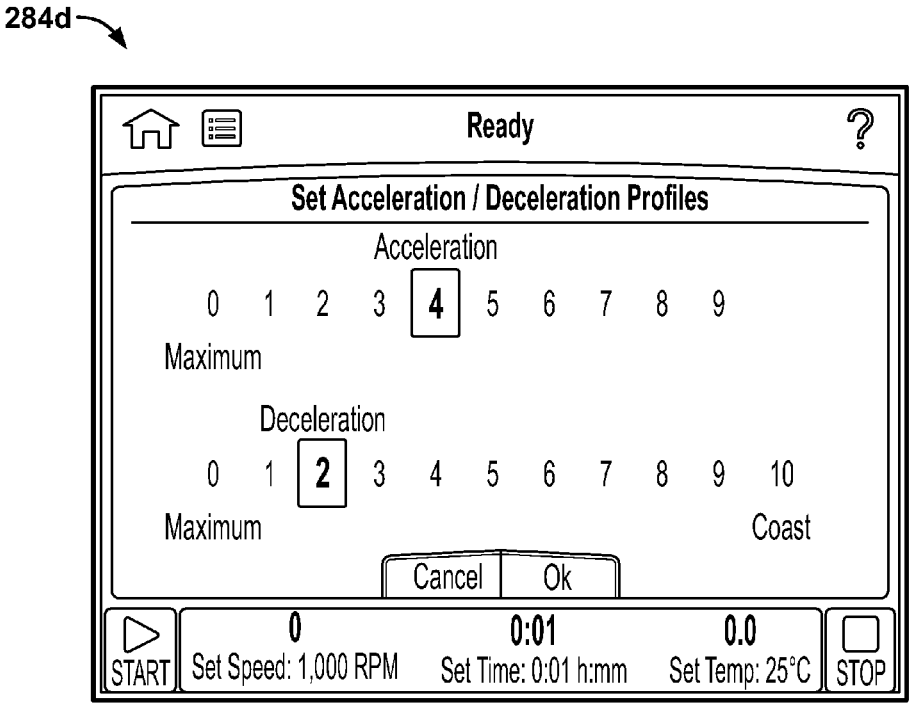
FIG. 12 depicts an input page for an acceleration and deceleration profile of an example centrifuge.

The acceleration/deceleration button 290 displays the preset acceleration and deceleration profiles entered by the user (or default values). Selecting the acceleration/deceleration button 290 brings up an input page 284*d* for selection of an acceleration and/or deceleration profile listed on the page (FIG. 12).

Figure 13:
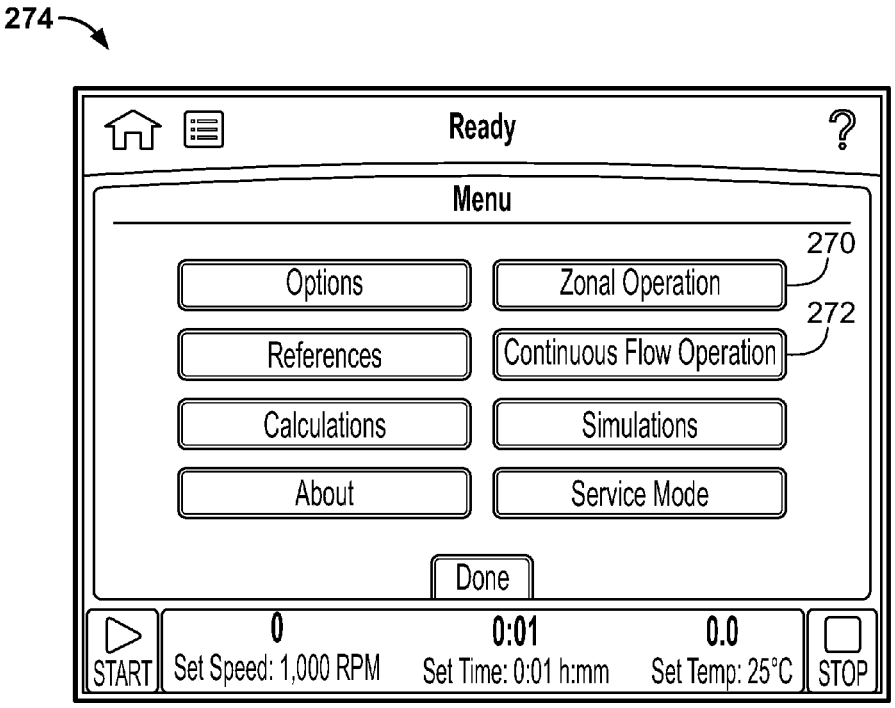
FIG. 13 depicts a menu page of an example centrifuge.

The homepage 200*a*, shown in FIG. 7, includes icons to allow a user to switch the mode of the centrifuge 100 to a zonal or continuous-flow centrifugation operation mode. For example, if the user selects menu button 206 on the homepage 200*a* a menu page 274 is displayed on the instrument display 130 (see FIG. 13). A user can then choose a rotor-accessible mode by selecting either the zonal centrifugation option 270 or the continuous-flow centrifugation option 272.

Figure 14:
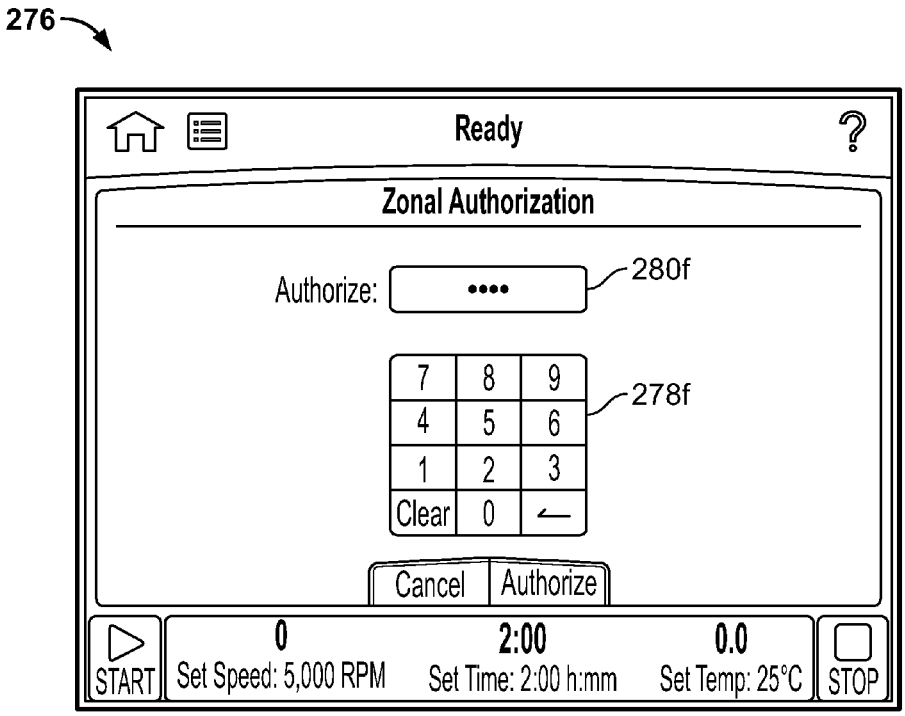
FIG. 14 depicts a rotor-accessible authorization page of an example centrifuge.

In one embodiment, after selecting either the zonal centrifugation option 270 or continuous-flow centrifugation option 272, an authorization page 276 is displayed on the instrument display 130 (FIG. 14). The authorization page 276 prompts the user to enter an authorization code into an entry box 280*f* using a keypad 278*f*. As rotor-accessible mode is inherently more dangerous, this serves two purposes. First it confirms that the user is authorized to operate the centrifuge 100 in the rotor-accessible mode. Second, it ensures that the user is physically present before switching to rotor-accessible mode (as opposed to the case where an authorized user has logged into the centrifuge with a proper username and password, but has left the instrument without logging out, leaving it available to subsequent unauthorized users).

Alternatively, in the embodiment illustrated in FIG. 7, a user can switch from conventional mode to rotor-accessible mode by selecting the zonal icon 266 on the side bar 268. After the user selects this icon, the centrifuge prompts for the authorization code on the authorization page 276 as described above (FIG. 14).

In the embodiments described above, the access to a rotor-accessible mode is provided if a proper authorization code is entered by the user. In other embodiments, authorized users of the rotor-accessible mode can be identified by a magnetic card, an RFID, an identification card, a biomarker, a physical key, or the like.

Because the rotor-accessible mode is inherently more dangerous than the conventional mode, it is advantageous that the centrifuge 100 provide an indication that it is in the rotor-accessible mode. This can be by any visual indication that readily distinguishes the rotor-accessible mode from the conventional mode. The indication can be by text or graphics displayed on the instrument display 130, or any combination thereof. The indication may also be an audible sound or tone that is used to identify the rotor-accessible mode.

Figure 15:
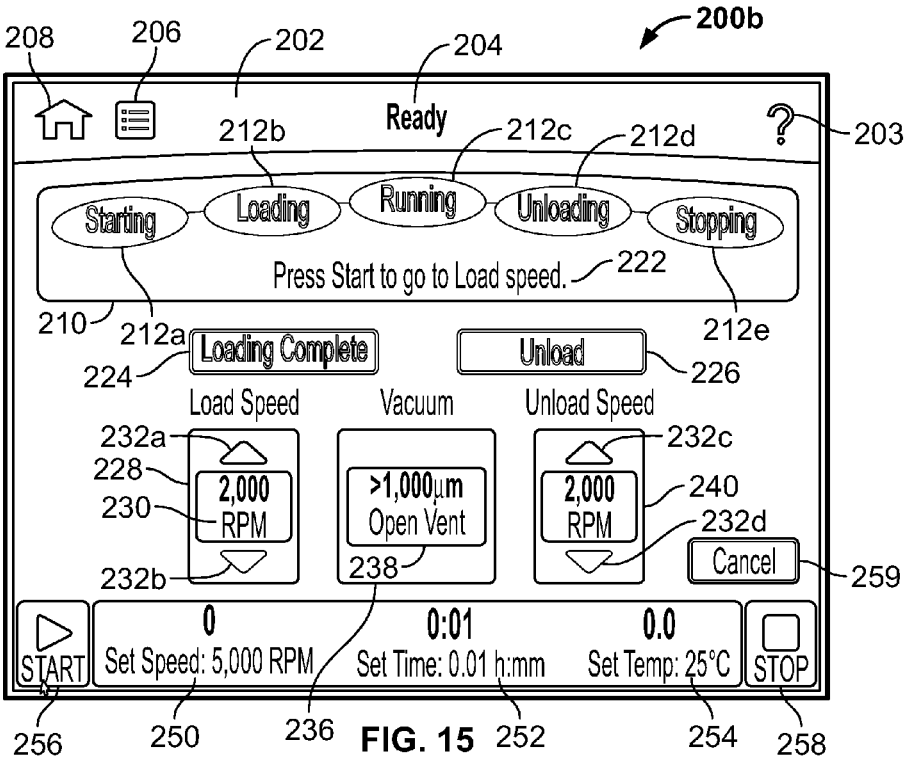
FIG. 15 depicts a homepage of an example centrifuge after selecting a zonal centrifugation operation.

Turning to FIG. 15, in one embodiment, an indication that the centrifuge is in the rotor-accessible mode may be a workflow diagram 210 that is displayed when a user selects a zonal or a continuous-flow centrifugation mode. The workflow diagram 210 depicts steps of the zonal or continuous-flow operation to safely guide the user though the operation. For example, the loading step of a zonal or continuous flow operation is especially dangerous because it is performed manually with the door 116 open and the rotor 106 spinning. The workflow diagram 210 informs the user the current step of the operation and raises his attention to plan and prepare for manual tasks that may be necessary.

In the illustrated embodiment of FIG. 15, the workflow diagram 210 includes step-indicators 212*a*, 212*b*, 212*c*, 212*d*, and 212*e* that correspond to five steps of a zonal centrifugation operation (starting, loading, running, unloading, and stopping, respectively). The step-indicators are selectively highlighted to show the current step of the centrifugation operation.

Before starting the zonal centrifugation operation, none of the step-indicators 212 are highlighted, see FIG. 15. During this time, preset centrifugation parameters for the running step of the zonal operation can be entered or changed from the default setting using the rotor-speed button 250, the run-time button 252, and the temperature button 254, as previously described. Additionally, rotor speeds for the loading and unloading steps can be entered using load-speed button 228 and unload-speed button 240, respectively.

Load-speed button 228 includes load-speed indicator 230 to display the preset load speed. The preset load speed can be increased or decreased by selecting the speed-adjust buttons 232*a*, 232*b* on the upper or lower portion of the load-speed button 228. Similarly, unload-speed button 240 includes unload-speed indicator to display the preset unload speed, which can be changed using the speed-adjust buttons 232*c*, 232*d*. In one embodiment, a default load speed and unload speed is displayed (and preset) on the load-speed indicator 230 and the unload-speed indicator, respectively. The default load and unload speeds may be restricted to a range, such as 2,000 RPM to 3,000 RPM, or 1,500 RPM to 4,500 RPM. Alternatively, the load and unload speeds may have a maximum limit, such as 3,000 RPM or 5,000 RPM. Because the user's need to access and work on the spinning rotor occurs during the loading and unloading steps, such a speed restriction makes sense.

Figure 16:
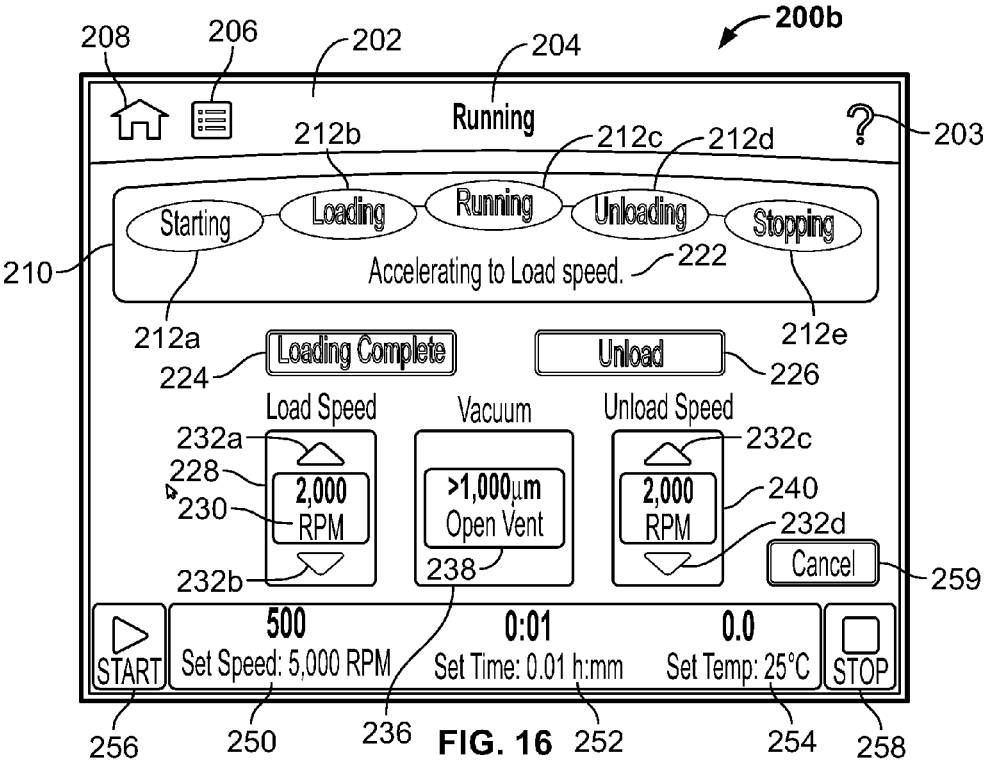
FIG. 16 depicts a homepage of an example centrifuge during the starting step of a zonal centrifugation operation.

Having entered the operation parameters, the centrifuge 100 is now ready. The homepage 200*b* displayed on the instrument display 130 shows the current preset values for easy review by the user. To begin the centrifugation operation, the user selects the start button 256. The processor 120 may then command or confirm the latch 118 is locked and the door 116 is closed. The processor also controls the drive motor to begin accelerating the rotor 106 to the preset load speed. During this time, the "starting" step-indicator 212*a* is highlighted to indicate that it is the current step of the operation, as shown in FIG. 16. The actual rotor speed is also displayed on the instrument display 130. As described above, the centrifugation parameters can be entered by the user through the input interface 132 of the instrument interface 126. In other embodiments, the centrifugation parameters, actual values, the workflow diagram, and the step-indicators can be entered and displayed also on a remote device.

Referring to FIG. 15, to further assist the user in safely performing the zonal centrifugation operation, the centrifuge 100 may display a help-statement 222 on the homepage 200*b*. The help-statement 222 informs the user of a manual task that she must perform before proceeding to the next step. During set-up before the starting step of a zonal operation has begun, the help-statement 222*b* may be one of: install zonal rotor; enter run parameters; enter load speed; enter run speed; enter unload speed; enter run time; and press start to go to load speed.

Figure 19:
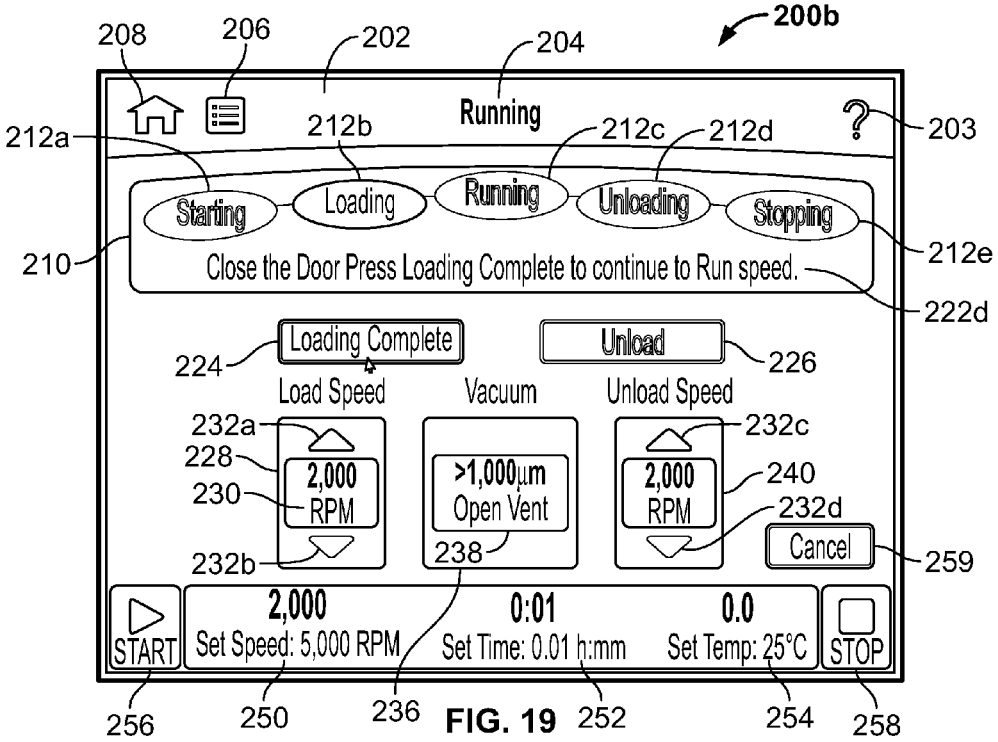
FIG. 19 depicts a homepage of an example centrifuge during the loading step of a zonal centrifugation operation.

When the rotor 106 reaches the preset load speed, the "loading" step-indicator 212*b* is highlighted to notify the user that the loading step is the current step, as shown in FIG. 19. During the loading step, the processor 120 unlocks the door 116, if needed, so that the door may be opened while the rotor 106 spins at the load speed. The user can now access the rotor 106 to install the fill-head and begin sample delivery into the zonal rotor. Because it is inherently dangerous to perform manual operations on a spinning rotor, in a preferred embodiment, the processor 120 activates an alert signal during the loading step. The alert may be audio or visual, and serves to notify the user and persons standing nearby that the rotor is spinning and the chamber 104 is uncovered. In one embodiment, the centrifuge 100 sounds an audible tone every five seconds when the door 116 is opened during the loading step. In another embodiment, the centrifuge 100 sounds the audible tone whenever the rotor 106 is spinning while the door 116 is in an unlatched position. The alert may be a flashing indicator on the instrument display 130, or a combination of audio and visual alerts.

After the sample is loaded onto the density gradient, the user manually removes the fill-head from the spinning rotor 106 and replaces the rotor cap. The user then closes the door 116 and presses the "loading complete" button 224.

In one embodiment, the centrifuge 100 includes a help-statement 222*d* to provide the user reminders. As shown in FIG. 19, the help-statement 222*d* informs the user to "Close the Door Press Loading Complete to continue to Run speed." In other embodiments, the help-statement 222*d* informs the user to do one of: load density gradient; load sample; remove fill-head; and install rotor cap.

Figure 20:
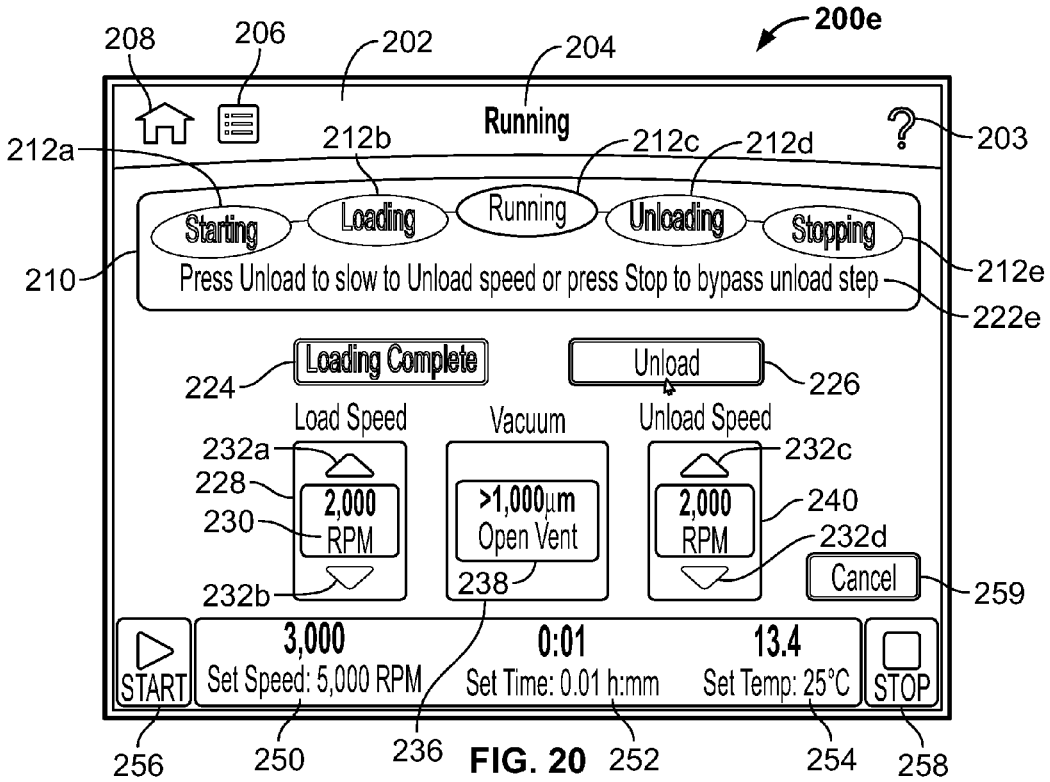
FIG. 20 depicts a homepage of an example centrifuge during the running step of a zonal centrifugation operation.

Upon detecting that the "loading complete" button has been depressed, the processor 120 confirms that the door 116 is closed, the latch 118 is automatically activated to lock the door 116 in place, and vacuum is applied to the rotor chamber 104. The processor 120 then controls the drive motor to begin accelerating the rotor 106 to the preset running speed. During this time, the "running" step-indicator 212*c* is highlighted to notify the user that it is the current step of the operation, as shown in FIG. 20. The actual rotor speed is also displayed on the instrument display 130. The running step is where separation of particles in the sample takes occurs, and the running speed may be 10,000 RPM up to 35,000 RPM.

During the running step, (and thereafter) the loading-complete button 224 is inactivated in the illustrated embodiment—It is grayed-out on the homepage 200*e* to indicate that the loading-complete button 224 is no longer active. Instead, unload button 226 is now active, as shown on the homepage 200*e*. If the user selects the unload button 226 before the preset run-time has elapsed, the centrifuge 100 will decelerate the rotor 106 to the preset unload speed displayed in the unload-speed indicator 240 and transition to the unloading step. If the user selects the stop button 258 before the preset run-time has elapsed, the centrifuge 100 will decelerate the rotor 106 to zero RPM and switch back to conventional mode. A help-statement may also be included for the running step. As illustrated in FIG. 20, homepage 200*e* includes the help-statement 222*e* "Press Unload to slow to Unload speed, or press Stop to bypass unload step."

Figure 21:
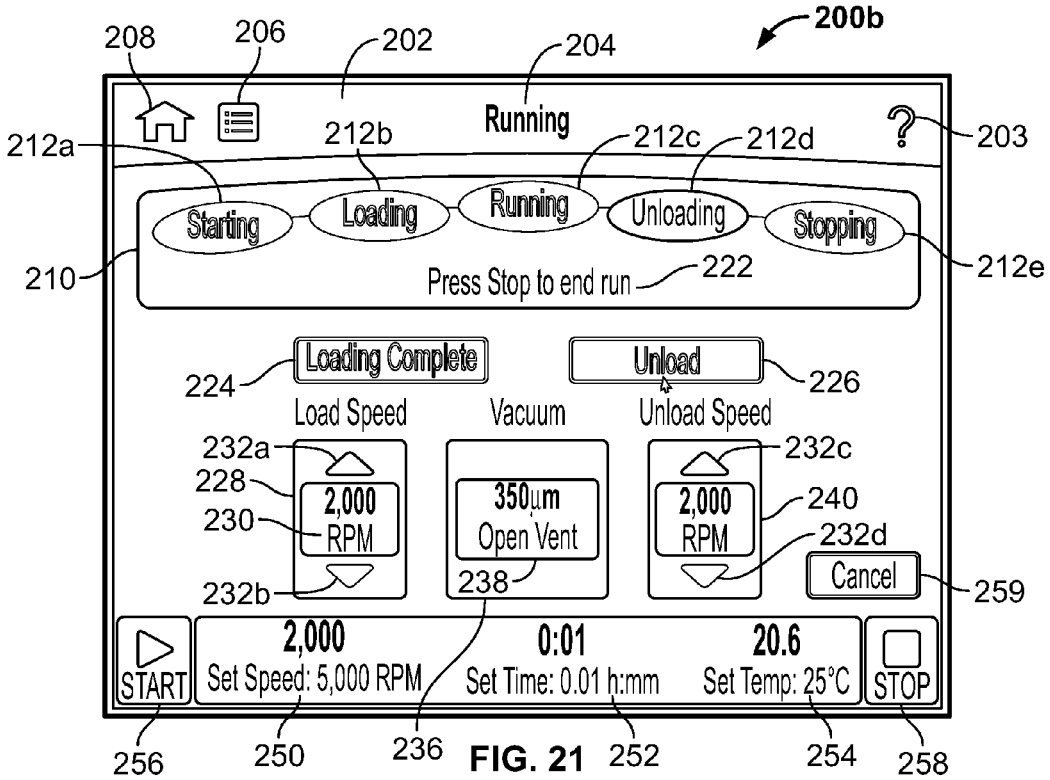
FIG. 21 depicts a homepage of an example centrifuge during the unloading step of a zonal centrifugation operation.

If neither the unload button 226 nor the stop button 258 is selected, the running step is completed when the preset run time is elapsed. As shown in FIG. 21, at this time the processor 120 sends signals to highlight the "unloading" step-indicator to notify the user that it is the current step of the centrifugation operation. The centrifuge 100 will then begin decelerating the rotor 106 to the preset unload speed. In one embodiment, the centrifuge 100 will not release the door latch 118 until a user has selected the vacuum button 236 to release the vacuum inside the rotor chamber 104. This ensures that the user is present when the door is unlatched while the rotor 106 is spinning.

With the vacuum released and the rotor speed reduced to the unload speed, the manual steps can now be performed. The processor 120 releases the door latch 118 so that the door 116 may be opened. The user can now access the rotor 106 to install the necessary apparatus to begin the sample unloading process. Similar to the loading step, the processor 120 activates an alert signal during the unloading step. The alert may be audio or visual, and serves to notify the user and persons standing nearby that the rotor is spinning and the chamber 104 is uncovered. In one embodiment, the centrifuge 100 sounds an audible tone every five seconds when the door 116 is opened. In another embodiment, the centrifuge 100 sounds the audible tone whenever the rotor 106 is spinning while the door 116 is in an unlatched position. The alert may be a flashing indicator on the instrument display 130, or a combination of audio and visual alerts.

During the unloading step, the centrifuge 100 indicates that the unloading step is the current step on the homepage 200*f* (FIG. 21), and displays help-statement 222, informing the user to press Stop to end the run. During the unloading step, both the loading-complete button 224 and the unload button 226 are inactive, and grayed-out on the homepage 200*b*.

Figure 22:
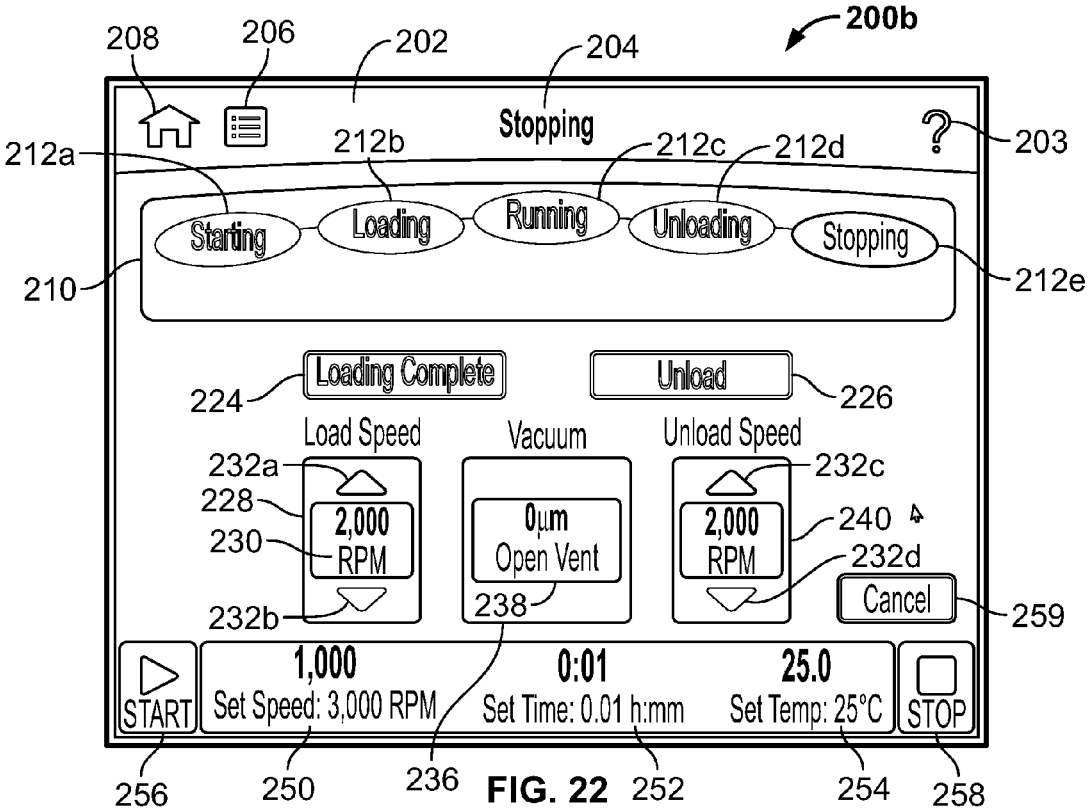
FIG. 22 depicts a homepage of an example centrifuge during the stopping step of a zonal centrifugation operation.

After the user has completed the manual tasks of the unloading step, he selects the stop button 258 on the homepage 200*b*. The centrifuge then indicates that the stopping step is the current step, and begins decelerating the rotor 106. FIG. 22 depicts the homepage 200*b* of a centrifuge 100 during the stopping step. In this embodiment, the stopping step is indicated by highlighting the stopping step-indicator 212*e*.

In the embodiment illustrated above, step-indicators 212*a*-212*e* are bubbles labeled with a centrifugation operation step. In other embodiments, the step-indicators 212*a*-212*e* may be text, icons, avatars, or any graphical representation that identifies the operation step. Indicating which step is the current step can include highlighting the step-indicator 212*a*-212*e* corresponding to that step. Highlighting can include displaying the step-indicator corresponding to the current step in a different color, foreground, background, border, intensity, font, and/or blink-rate relative to the other displayed step-indicators. Highlighting can also include animating, decorating, or pointing to the step-indicator 212 corresponding to the current step. Highlighting can include any visual representation that distinguishes the step-indicator 212 of the current step from other step-indicators 212.

Figure 17:
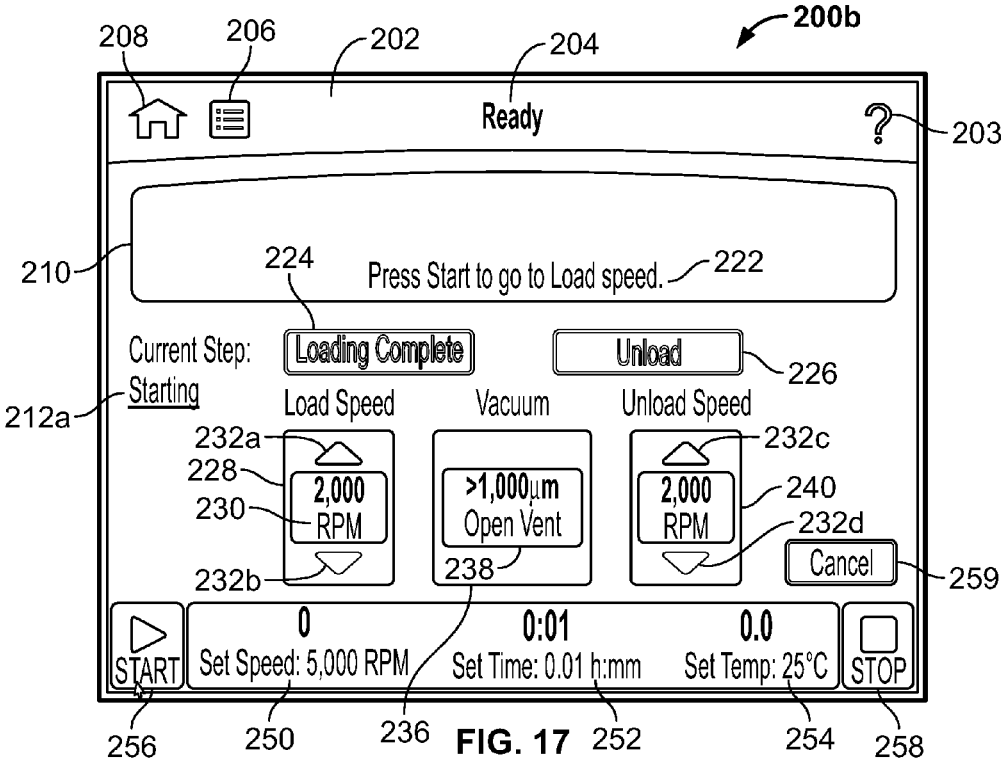
FIG. 17 is an example of highlighting by displaying a single step-indicator.
Figure 18:
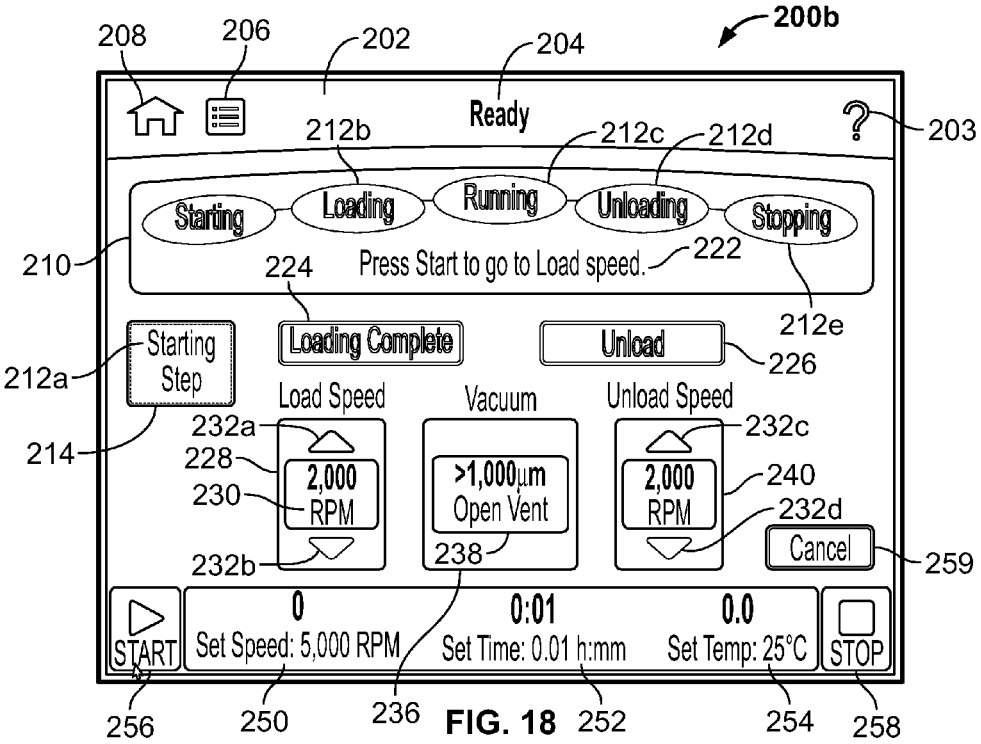
FIG. 18 is an example of highlighting by displaying a step indicator in a particular region of a page.

In other embodiments, indicating which step is the current step includes displaying a single step-indicator 212 on the homepage 200, such as the starting step-indicator 212*a* in FIG. 17. In other embodiments, indicating the current step includes displaying the step-indicator 212 corresponding to the current step at a region on the homepage 200 that distinguishes it from the other step-indicators 212, such as the region 214 in FIG. 18. In other embodiments, indicating the current step includes associating a label with the corresponding step-indicator 212. Unique audible tones may also indicate the current step of the centrifugation operation.

Figure 23:
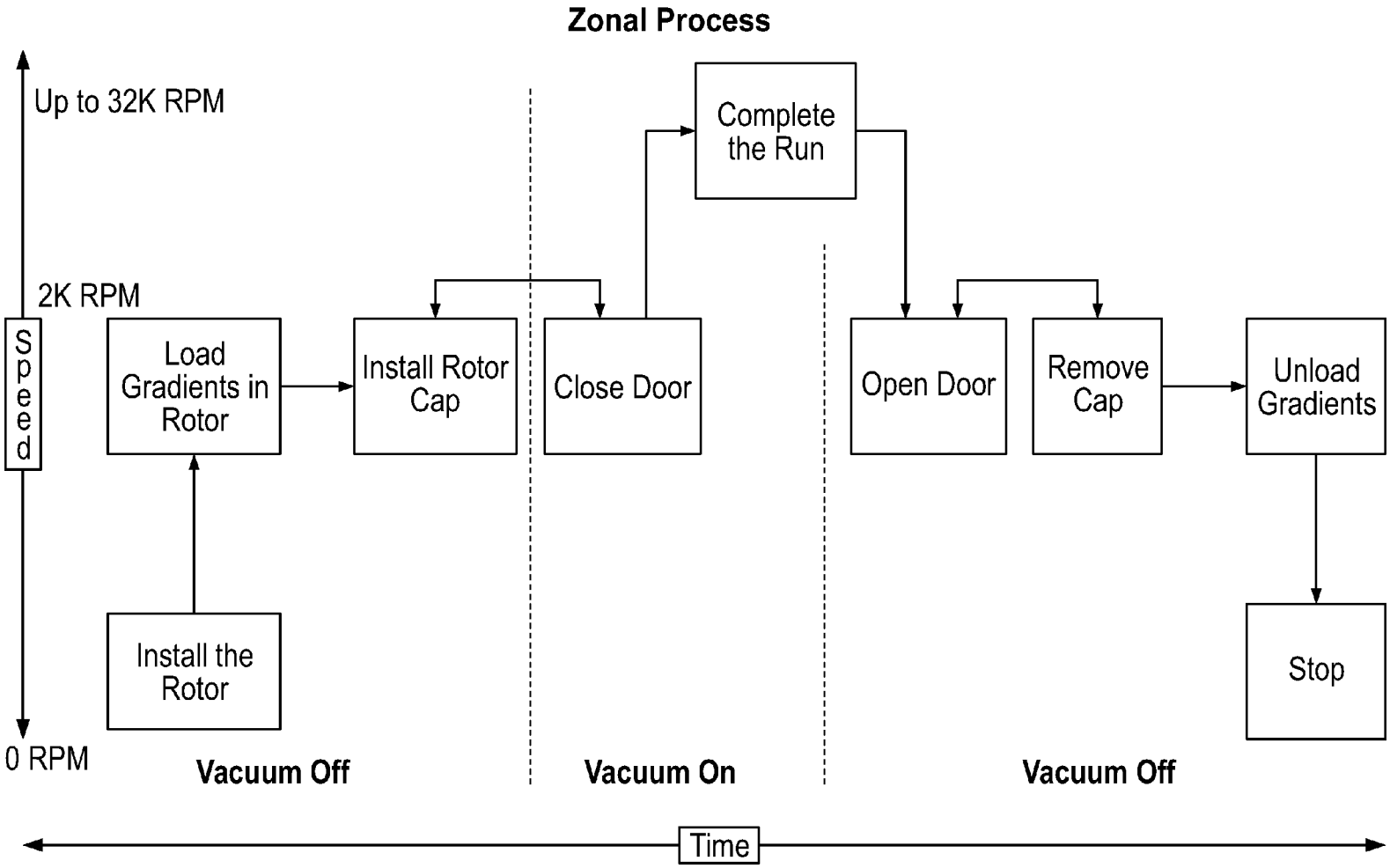
FIG. 23 diagrams the manual tasks of a zonal centrifugation operation.

FIG. 23 outlines the manual tasks associated with a zonal centrifugation operation, indicating the approximate rotor speeds associated with the different steps of the zonal operation (left-hand side of the figure) and the atmospheric pressure associated with the steps (at the bottom of the figure).

Figure 24:
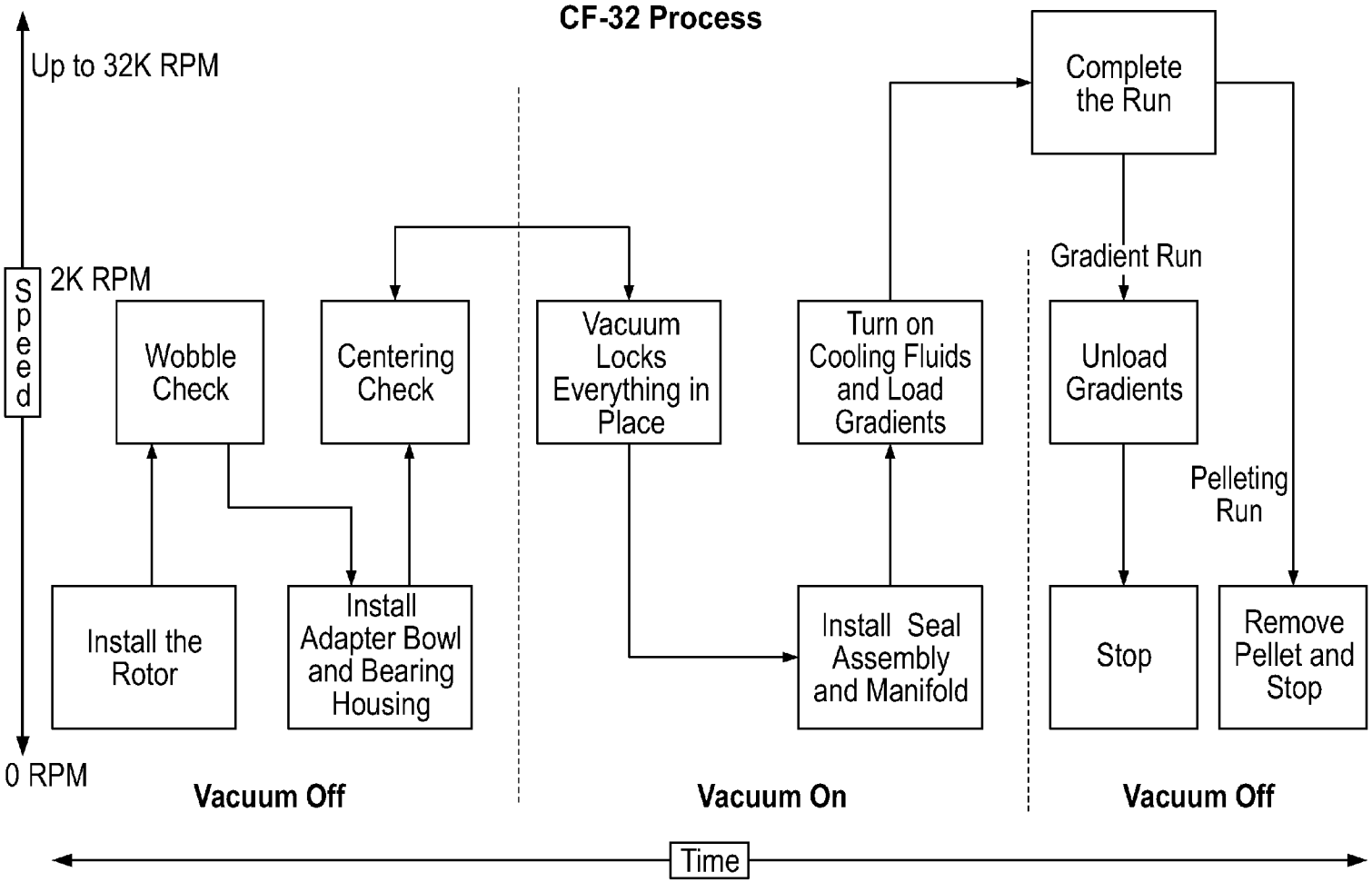
FIG. 24 diagrams the manual tasks of a continuous flow operation.

FIG. 24 outlines the manual tasks of a continuous-flow centrifugation operation. One difference between a zonal and a continuous-flow centrifugation operation is the need to slow back down to zero RPM during assembly of the continuous flow loading apparatus (during the step of installing the adapter bowl and bearing housing, and the step of installing the seal assembly and manifold, in FIG. 24). In this respect, the loading step of a continuous-flow centrifugation operation may include a step of slowing the rotational speed of the rotor to zero RPM between manual tasks of the phase. For example, the loading step of the continuous-flow centrifugation operation may include the task of checking wobble of the rotor at approximately 2,000 RPM, followed by slowing the rotor to zero RPM to install the adapter bowl and bearing housing.

Figure 25:
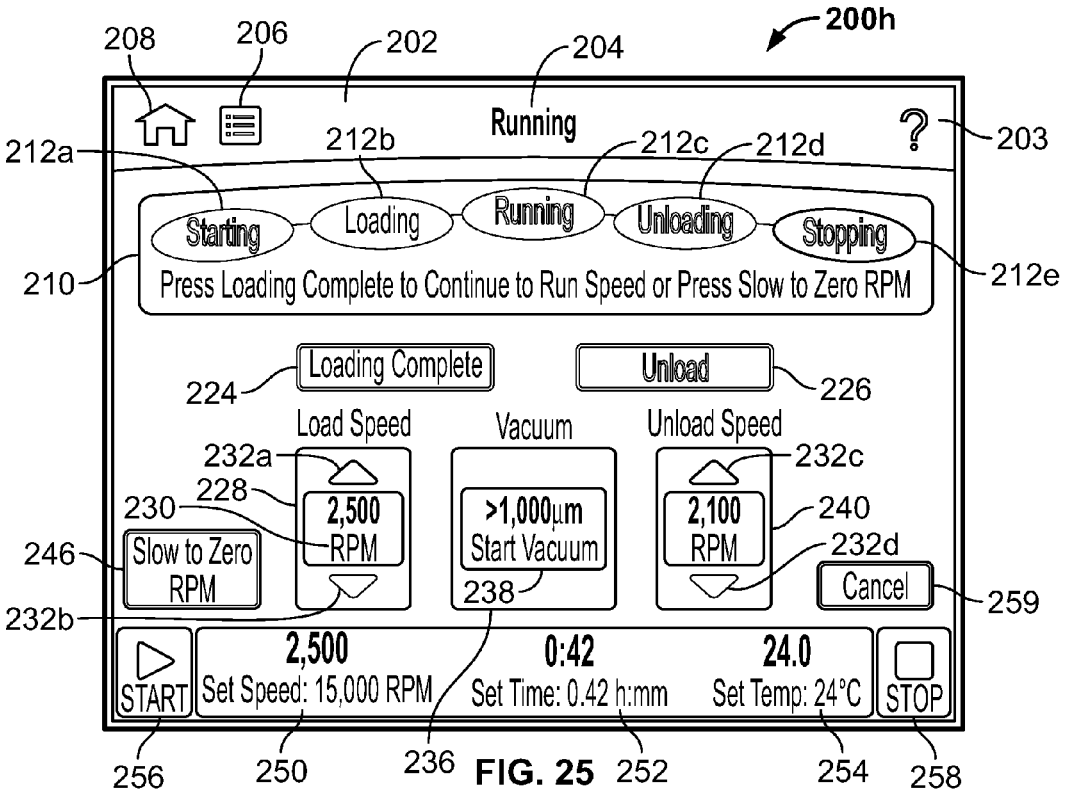
FIG. 25 depicts a homepage of an example centrifuge during the loading step of a continuous-flow centrifugation operation.

FIG. 25 depicts the homepage 200*h* of a centrifuge 100 of this embodiment during the wobble check. The 'Loading' bubble (step-indicator 212*b*) is highlighted, indicating that this is the current step of the continuous-flow operation and that the rotor 106 may be spinning with the door 116 open. The actual rotational speed of the rotor is 2,500 RPM, as indicated by the rotor-speed button 250, to allow the user to manually check for wobble of the rotor 106. Homepage 200*h* includes a zero button 246. After performing the wobble check, the user selects this button, causing the centrifuge 100 to slow the rotor 106 to a stop, thus allowing the user to proceed to the next task of installing the adapter bowl and bearing housing while the rotor 106 is stationary. After completing this task, the user can select the start button 256 to accelerate the rotor 106 back up to the preset load speed. After the manual tasks of the loading step are complete, the user selects the loading-complete button 224, guided by the help statement 222*h* ("Press Loading Complete to continue to Run Speed or press Slow to Zero RPM"). Upon receiving this input, the centrifuge 100 proceeds to the running step of the continuous-flow centrifugation operation by increasing the rotor speed to the preset run-speed.

After proceeding to the running step of the continuous-flow centrifugation operation, the step-indicator 212*c* is highlighted, indicating that it is now the current step of the continuous-flow centrifugation operation. The zero button 246 is grayed-out, indicating that this option is not available during the running step of the continuous-flow operation.

Having described the centrifuge 100 in detail, the remote device 20 will now be described. Referring back to FIGS. 1-3, the centrifuge system 10 includes the remote device 20 communicatively coupled to the centrifuge 100 through network 30. Remote device 20 is preferably wirelessly connected to the network 30. Preferably, the remote device 20 is a handheld device. In some embodiments, the remote device runs iOS 4.3 or later, and is adapted to command actions of the centrifuge 100 by sending instructions to the processor 120 over the network 30. In this way, the remote device 20 can control the centrifuge 100, where control means that the processor 120 causes a change in a preset or actual centrifugation parameter based on an instruction received from the remote device 20.

Figure 26:
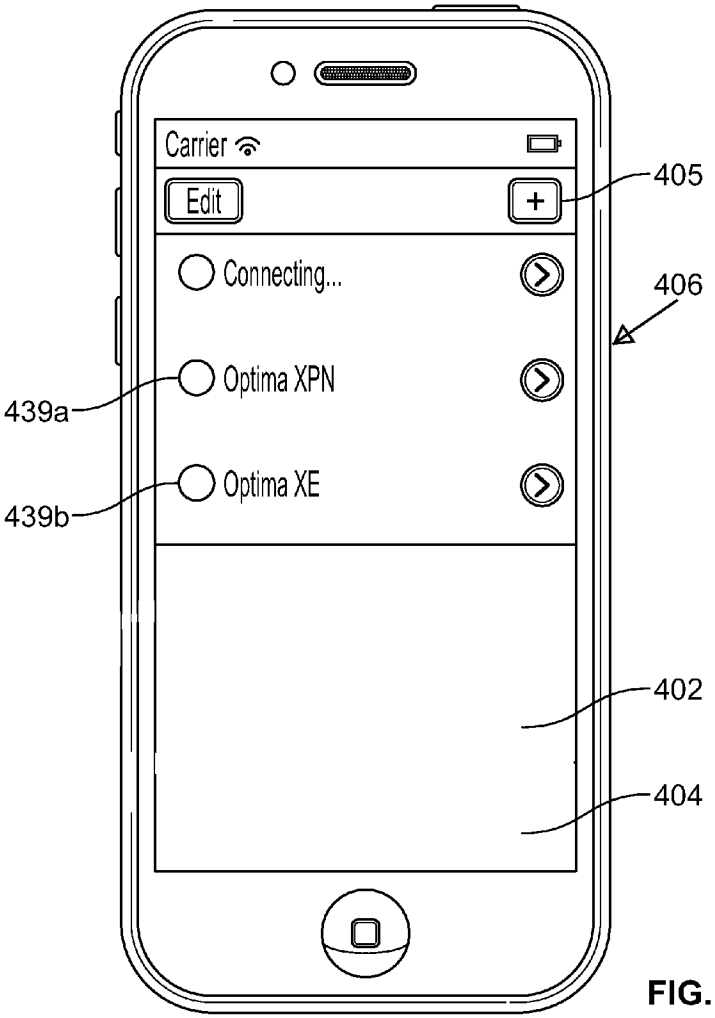
FIG. 26 illustrates an example interface of a remote device.

As shown in FIG. 26, in one embodiment, the remote device 20 includes a device interface 402 including a screen 404 and input attributes 406. The device interface 402 displays information on the device screen 404 and input attributes 406 allow the user to make selections and enter desired information. In a preferred embodiment, the device interface 402 is a touch-sensitive screen and serves both as a display screen and as an information entering device.

Figure 27:
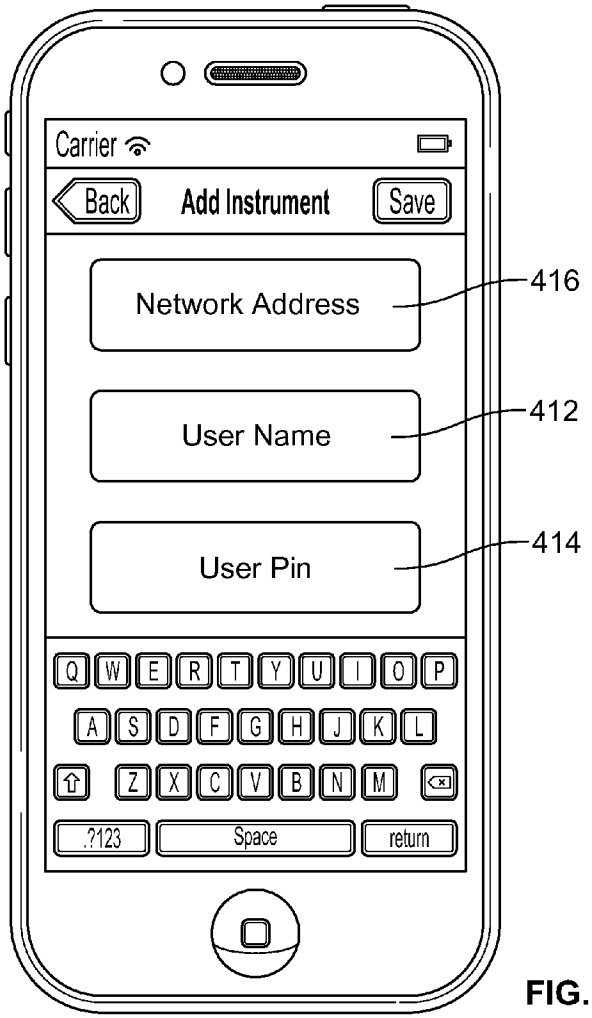
FIG. 27 illustrates another example interface of the remote device.

As shown in FIG. 26, the remote device 20 may display a list of centrifuges or instruments it is currently connected. As illustrated, the remote device 20 is communicatively coupled to a first centrifuge (e.g., Optima XPN) and a second centrifuge (e.g., Optima XE). If the user desires to connect to a new centrifuge, he may select an add button 405. Selecting the add button 405 launches an Add Instrument page as shown in FIG. 27. There, the user is prompted to enter his user information. Like centrifuge 100, the user information includes the username 412 and PIN 414. The user is also prompted to enter the network address 416 of the desired centrifuge. The network address 416 of a centrifuge may be an IP address, an alphanumeric network name, or any suitable identifier to locate a device in the network 30. Like in the authorization process described above, if the username 412 and PIN 414 agrees with the authorized user data stored in memory located, for example, in a central server or the centrifuge 100, access is granted and the remote device 20 and the centrifuge 100 is communicatively coupled. By observing this protocol, remote access to information regarding the centrifuge 100 can be controlled, managed, and be made in a secure manner.

Circumstances will arise where both a remote device 20 user and a local user at the centrifuge 100 attempt to access the same centrifuge. In such a situation, in one embodiment, the local user shall trump the remote user and gain control of the centrifuge 100. Such a hierarchy is reasonable because the local user is better positioned to appreciate the situation near the centrifuge. Also, it is not desirable to have the centrifuge turn on without a local user's awareness. Other circumstances may involve two remote users attempting to connect to the same centrifuge. In this circumstance, the user information, i.e., the username and PIN, may be given a ranking by, for example, an administrator ahead of time. In this way, which remote user gains control can be resolved simply and effectively.

However, although a remote user may not gain control of the centrifuge 100 over the local user or another remote user, in one embodiment every remote device 20 will still receive information about the centrifuge 100 so long as the user information agrees with the authorized user data. That is, the preset and actual rotor speed, run time, chamber temperature, and the status bar indication from the connected centrifuge 100 will be displayed on the device screen 404 of the remote device 20. Moreover, in one embodiment, the stop button 434 on every authorized and connected remote device 20 will remain selectable despite a local user control of the centrifuge. Accordingly, a remote device 20 may still be able to abort a centrifugation operation. This is advantageous for example, for a lab supervisor who monitors centrifuges running in a lab; and if she was to receive information that compels her to terminate an operation, she may take action remotely regardless of other users. Similarly, if a user learns that the labware used on the centrifuge is defective or that the wrong sample is being processed, he may take action and terminate the centrifugation operation remotely.

Figure 29:
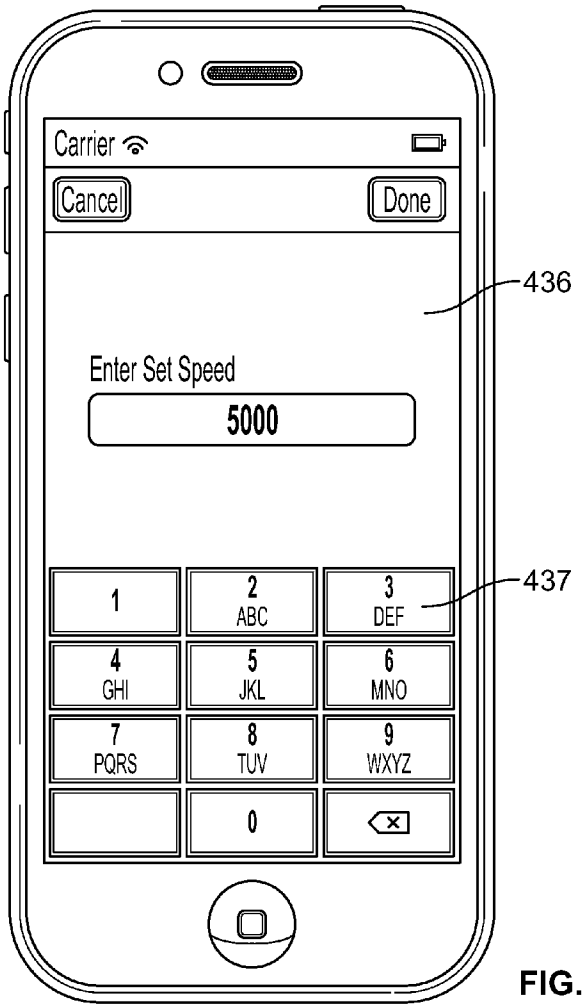
FIG. 29 illustrates another example interface of the remote device.
Figure 28:
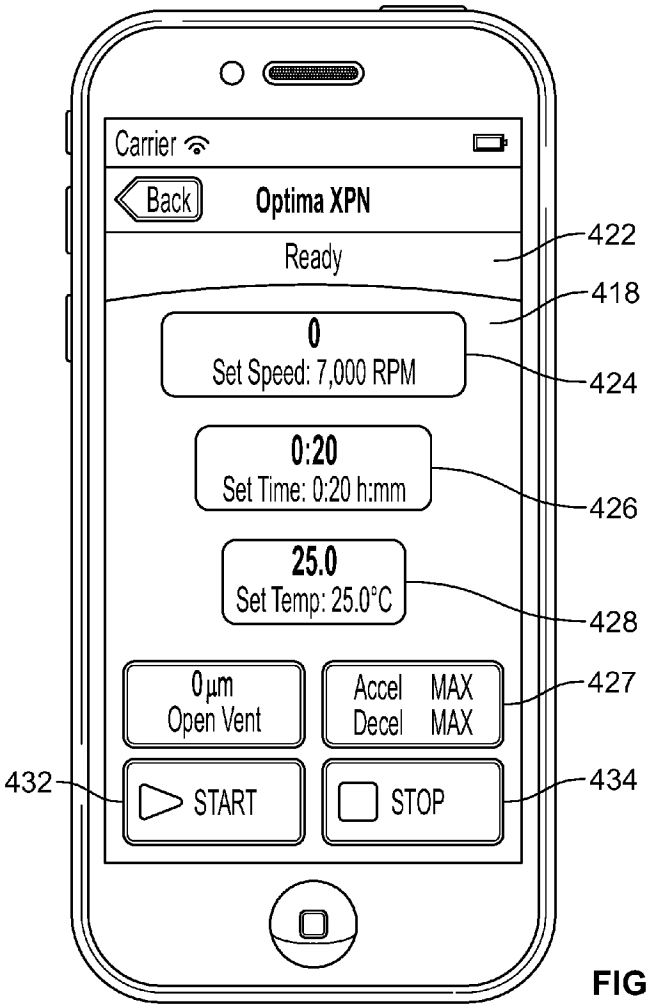
FIG. 28 illustrates another example interface of the remote device.

To communicate with a specific centrifuge, the user may select the desired centrifuge from the list as shown in FIG. 26. Again, the preferred embodiment is a touch sensitive screen. By selecting the line for the first centrifuge (e.g., as indicated as Optima XPN), a page is launched that displays information about that centrifuge as shown in FIG. 28. The main page 418 has information similar to the homepage 200*a* of centrifuge 100. The main page 418 includes a status bar 422, a rotor speed button 424, a run-time button 426, an acceleration/deceleration button 427, a temperature button 428, a start button 432, and stop button 434. These buttons each serve as a display screen and a selection area. For example, the rotor speed button 424 displays the preset rotor speed (shown 7,000 RPM) and actual rotor speed (shown 0). These speed values are the same values displayed on the instrument display 130 of the centrifuge 100 (in this example, the Optima XPN). The remote device 20 may also be used to enter a preset value by selecting, for example, the rotor speed button 424. Once selected, a set screen 436 will be displayed as shown in FIG. 29. From the set screen 436, the user may use the keypad 437 to enter the desired rotor speed.

Figure 30:
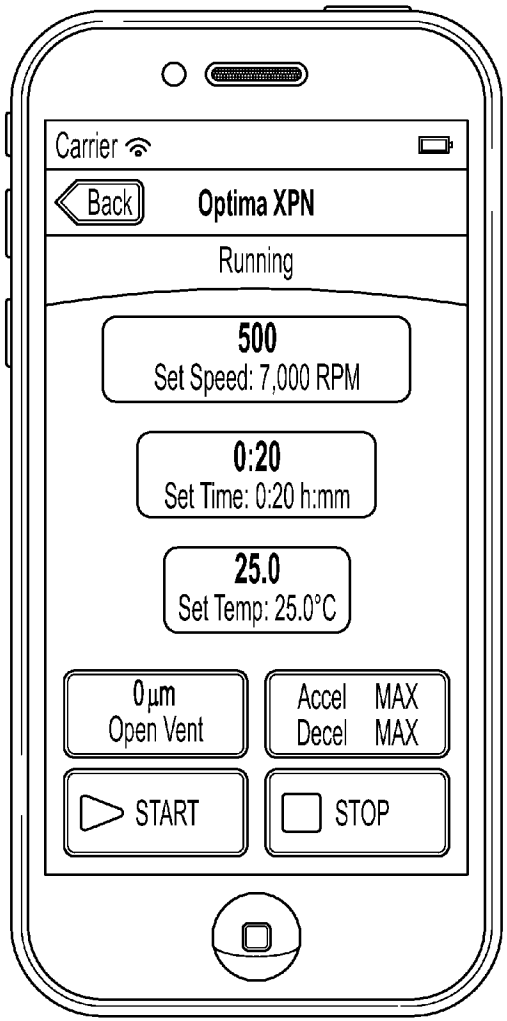
FIG. 30 illustrates another example interface of the remote device.

Other preset parameters can be entered similar to what is described above. Once, the desired preset parameters are entered, the remote device 20 may activate a conventional centrifugation operation by selecting the start button 432. As shown in FIG. 30, the status bar changes to "running" to indicate that centrifuge 100 has begun its operation. When the preset run time elapses, the centrifuge will decelerate to a stop and the centrifugation operation will be completed. During the centrifugation operation, the actual operation data including, rotor speed, chamber temperature, and run time, are displayed on the device screen 404 of the remote device 20. Also, the workflow diagram 210 or individual step-indicators, as described above with centrifuge 100, may also be displayed on the screen 404 of the remote device 20.

The control of a centrifuge 100 by the remote device 20 may also be limited according to the mode of centrifuge operation. For example, in one embodiment, the remote device 20 may have full control of a centrifuge for the purpose of a conventional operation as described above. However, the remote device 20 may be restricted from selecting a rotor-accessible operation, such as zonal operation, because those operations require that a user be at the centrifuge to perform the manual tasks. Notwithstanding, even if the centrifuge is placed in the rotor-accessible mode, a remote device 20 connected to that centrifuge may still have the limited control to stop the operation by selecting the stop button 434.

Turning back to FIG. 26, the remote device 20 also provides a status indicator 439 for each centrifuge it is communicatively coupled. In the illustrated example, the remote device 20 is coupled to the first centrifuge (e.g., Optima XPN) and second centrifuge (e.g., Optima XE). Adjacent to each name, status indicator 439*a*, 439*b* provides an immediate view of the status of a centrifuge. Here, the status indicator 439*a* for the first centrifuge (e.g., Optima XPN) is blue, which indicates that it is idle and ready. And the status indicator 439*b* for the second centrifuge (e.g., Optima XE) is red, which indicates that it is experiencing a major malfunction. These status indicators have color designations identical to the status bar 202 color scheme on the centrifuge 100.

Figure 31:
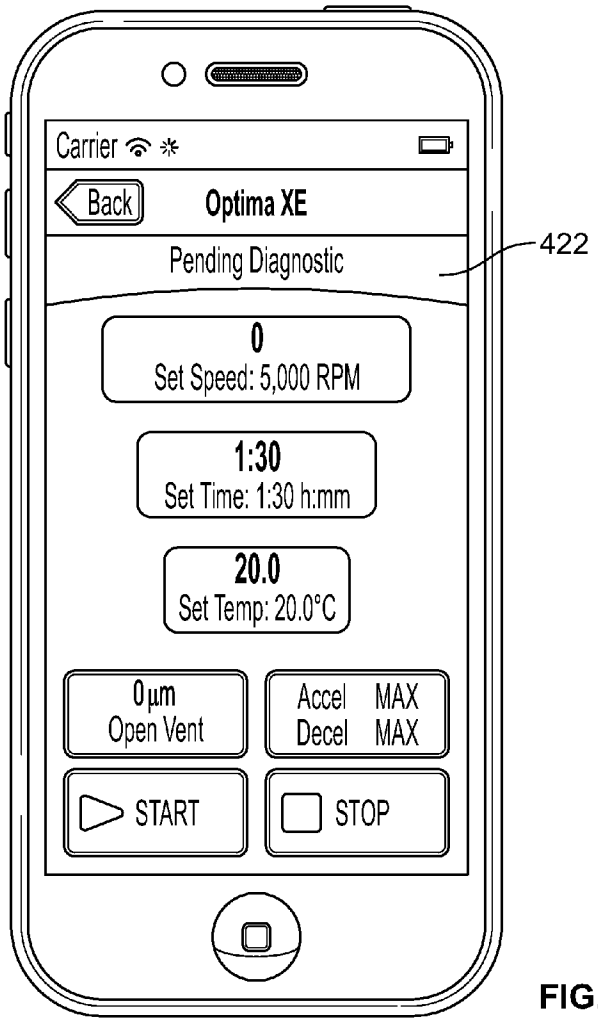
FIG. 31 illustrates another example interface of the remote device.
Figure 32:
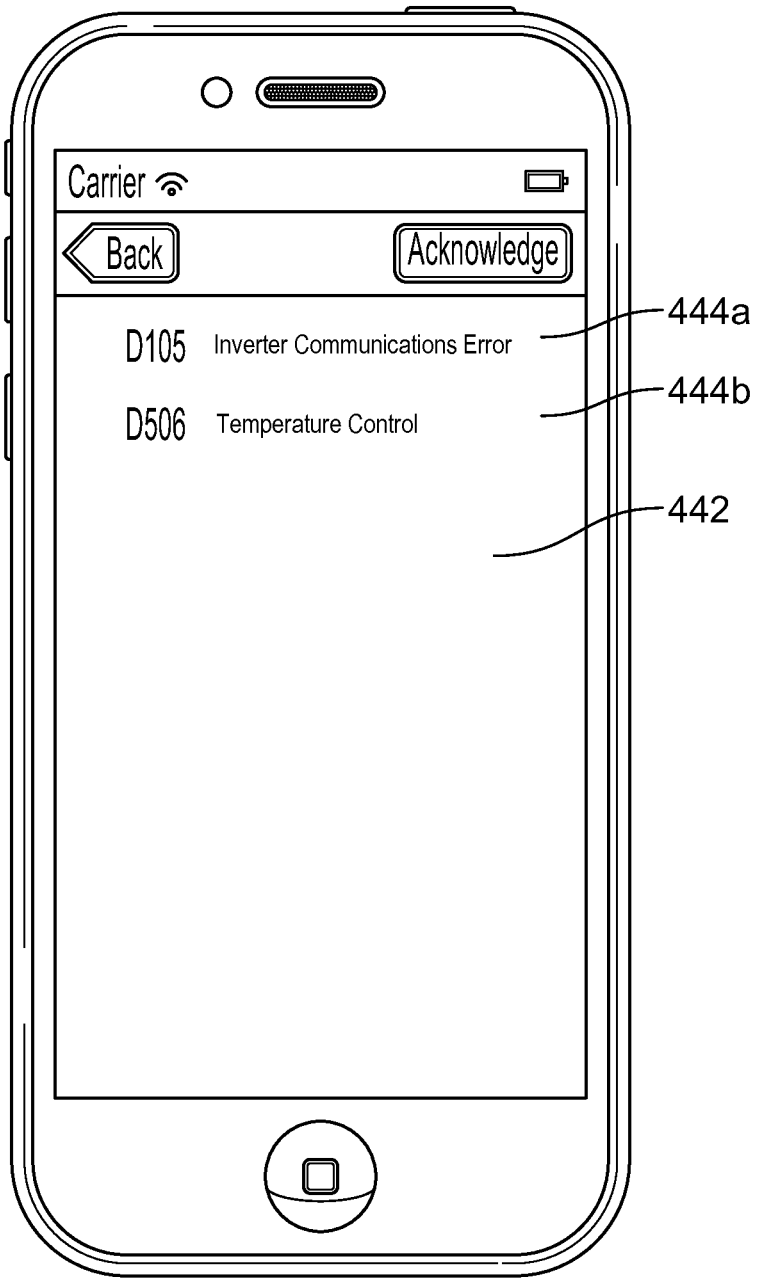
FIG. 32 illustrates another example interface of the remote device.

To investigate a connected centrifuge, the remote user can select from the list of connected centrifuges as shown in FIG. 26. For example, the remote user may wish to get additional information about the red status indicator 439*b* associated with the second centrifuge (e.g., Optima XE). The user can select this centrifuge by touching the instrument line that launches a page that displays information about that centrifuge as shown in FIG. 31. Consistent with the red status indicator 439*b* from the main list, the status bar 422 is also red. To get diagnostic information, the user may select the status bar 422. Selecting the status bar launches page shown on FIG. 32, which displays an error list 442 including error conditions 444*a*, 444*b*. These error conditions 444*a*, 444*b* are based on centrifuge's operation information. That is, centrifuge 100 includes sensors, devices, and software to monitor its own operation. If the operation information produced by the centrifuge exceeds, for example, a threshold criteria, a minor or major malfunction flag may be raised. Based on this analysis, error conditions 444*a*, 444*b* are generated, and the color of the status bar 422 and status indicator 439*a*, 439*b* are changed.

Accordingly, the remote device 20 provides functionalities that allows remote monitoring of one or more centrifuges, and that provides status and diagnostic information about the connected centrifuges to ensure, for example, that laboratory operation is proceeding safely and, if necessary, take action.

Additional Embodiments

Additional embodiments include any one of the following and combinations thereof:

A method of performing a zonal centrifugation operation, the method comprising the steps of: a. indicating, on a instrument display of a centrifuge, that a loading step is the current step of the zonal centrifugation operation; b. delivering, while a zonal rotor is spinning and accessible to a user, a sample onto a density gradient in the zonal rotor; and c. indicating, on the instrument display of the centrifuge after the loading step is complete, that a running step is the current step of the zonal centrifugation operation, wherein the step of delivering a sample onto a density gradient is part of the loading step.

A method wherein the step of indicating that the loading step is the current step includes displaying a loading step-indicator.

A method further comprising the step of displaying, on the instrument display of the centrifuge, a plurality of step-indicators that corresponds to at least two steps of the zonal centrifugation operation, the plurality of step-indicators includes a loading step-indicator.

A method wherein the step of indicating that the loading step is the current step includes highlighting the loading step-indicator.

A method wherein highlighting the loading step-indicator includes displaying the loading step-indicator in a different color than other step-indicator.

A method wherein highlighting the loading step-indicator includes displaying the loading step-indicator in one of a different background, foreground, border, intensity, font, and blink rate, than other step-indicator.

A method wherein the plurality of step indicators further includes step-indicators corresponding to a running step, and an unloading step.

A method further comprising the step of displaying a load speed on the instrument display during the loading step.

A method wherein the load speed is a preset rotational speed of the zonal rotor during the loading step of the zonal centrifugation operation.

A method further comprising displaying, on the instrument display, a help-statement that informs a user of a manual task necessary to complete the loading step.

A method wherein the help-statement informs the user to do one of load density gradient, load sample, install fill-head, remove fill-head, install rotor cap, and press loading complete.

A method further comprising the step of displaying a loading-complete button on the instrument display of the centrifuge, and indicating, on the instrument display of the centrifuge, that the running step is the current step of the zonal centrifugation operation only after a user activates the loading-complete button.

A method wherein the step of delivering the sample onto the density gradient is performed while the zonal rotor is spinning at a rotational speed of approximately 2,000 to 3,000 RPM.

A method further comprising the step of increasing the rotational speed of the zonal rotor to a run speed after the loading step is complete.

A method wherein the run speed is between about 10,000 and 35,000 RPM.

A method further including the step of displaying the rotor speed of the centrifuge on a screen of a remote handheld device, wherein the handheld device is wirelessly communicatively coupled to the centrifuge.

A method further including the step of displaying the loading step-indicator on a screen of a handheld device, wherein the handheld device is communicatively coupled to the centrifuge.

A centrifuge system comprising: a centrifuge including an instrument interface adapted to receive a command, entered by a first user, to control centrifuge action; a remote device communicatively coupled to the centrifuge, the remote device including a device interface adapted to receive a command, entered by a second user, to control centrifuge action; and a processor adapted to limit the control of centrifuge action by the remote device based on a mode of operation of the centrifuge.

A centrifuge system wherein the first user and the second user is the same user.

A centrifuge system wherein the processor is configured to limit the control of centrifuge action by the remote device if the centrifuge is in a rotor-accessible mode of operation.

A centrifuge system wherein the rotor-accessible mode of operation is a zonal centrifugation operation.

A centrifuge system wherein the zonal centrifugation operation includes the steps of loading, running, and unloading, wherein the processor is further adapted to generate an audible alarm during at least a past of the step of loading.

A method of operating a centrifuge, the method comprising: displaying a workflow diagram of a centrifuge operation on an instrument display of the centrifuge, the workflow diagram including a step-indicator of loading sample into a zonal rotor; loading sample into a rotor while the rotor is accessible to a user and while the rotor is spinning at a first speed; indicating completion of the step of loading sample; and increasing rotor speed to a second speed.

A method wherein the rotor is arranged in a chamber and a door covering an access to the rotor is disposed about the chamber, the door automatically locking to prevent user access to the rotor before the step of increasing rotor speed to the second speed.

A method further including the step of applying vacuum in the chamber after the door is automatically locked.

A method wherein the first speed is between 2,000 rpm and 3,000 rpm.

A method wherein the second speed is between 10,000 and 35,000 rpm.

A method wherein the first speed is 3,000 rpm maximum.

A method wherein the first speed and second speed is preset by the user.

A method further including the step of activating an alert during the step of loading sample into the rotor.

A method wherein the alert is an audible alert.

A method further including the step of activating an audible alert when the door is unlocked and the rotor is spinning.

A method wherein the step-indicator of loading sample is highlighted during the step of loading sample into a rotor.

A method wherein the step-indicator is highlighted by illumination.

A method wherein the step of displaying the centrifuge rotor speed on a screen of a remote device, the remote device communicatively coupled to the centrifuge over the internet.

A method of operating a centrifuge, the method comprising: displaying a workflow diagram of a centrifuge operation, the workflow diagram including a loading step-indicator, a running step-indicator, and an unloading step-indicator; loading sample into a rotor while the loading step-indicator is highlighted and while the rotor is spinning at a first speed; spinning the rotor at a second speed while the running step-indicator is highlighted; and unloading sample from the rotor while the unloading step-indicator is highlighted and while the rotor is spinning at a third speed.

A method wherein access to the spinning rotor is provided to a user during the step of loading sample.

A method wherein the first speed and the third speed are the same speed.

A method wherein the step of loading sample includes a manual operation performed by a user.

A method wherein the rotor is arranged in a chamber, the chamber including an access door, the step of loading sample into the rotor includes having the access door open while the rotor is spinning.

A method wherein an audible alert is activated while the access door is open and the rotor is spinning.

A method wherein the first speed and the third speed are 3,000 rpm maximum.

A method wherein step-indicators are individually highlighted by one of illumination, color differentiation, and blink rate.

A method wherein the workflow diagram includes step-indicators corresponding to steps of a zonal centrifugation.

A centrifuge system comprising: a centrifuge including a motor, a rotor, a centrifuge interface, and an instrument display, the rotor driven by the motor, the centrifuge interface configured to enter a first user information, the instrument display configured to display actual operation data; a handheld communicatively coupled to the centrifuge, the handheld including a screen having a handheld interface, the handheld interface configured to enter a second user information, the screen configured to display actual operation data; a memory including stored authorized user data, wherein actual operation data is displayed on the instrument display if the first user information entered agrees with the authorized user data stored in the memory, and the actual operation data is displayed on the screen if the second user information agrees with the authorized user data stored in the memory, wherein if both the first user information and the second user information agree with the authorized user data, only one of the centrifuge interface and handheld interface may be used to set a rotor speed for the centrifuge.

A centrifuge system wherein user information includes a username and a password.

A centrifuge system wherein the authorized user data includes a plurality of user information.

A centrifuge system wherein if both the first user information and the second user information agree with the authorized user data, only the centrifuge interface may be used to set the rotor speed of the centrifuge.

A centrifuge system wherein if the second user information agrees with the authorized user data, the handheld interface may be used to terminate centrifuge operation by entering a stop command.

A centrifuge system wherein the memory includes user ranking, and wherein if both the first user information and the second user information agree with the authorized user data, user ranking will define which one of the centrifuge interface and handheld interface may be used to set a rotor speed for the centrifuge.

A centrifuge system wherein the instrument display further displays a workflow diagram of a centrifugation operation.

A centrifuge system comprising: a centrifuge including a motor and a rotor, the rotor driven by the motor, wherein the centrifuge produces operation information; and a handheld device communicatively coupled to the centrifuge, the handheld device including a screen, the screen displaying condition information of the centrifuge, the condition information based on centrifuge operation information, the screen further displaying a stop button that can be selected by a user to terminate the operation of the centrifuge.

A centrifuge system wherein the handheld screen displays actual rotor speed of the centrifuge.

A centrifuge system wherein the handheld device is configured to set a rotor speed for the centrifuge.

A centrifuge system wherein the handheld screen displays a workflow diagram of a centrifuge operation, the workflow diagram including step-indicators corresponding to steps of a centrifuge operation.

A centrifuge system wherein the steps of a centrifuge operation includes at least a loading step-indicator and a running step-indicator.

A centrifuge system further comprising a second handheld device wirelessly coupled to the centrifuge, the second handheld device including a screen displaying a stop button that can be selected to terminate the operation of the centrifuge.

A centrifuge system wherein the condition information indicates a centrifuge problem.

A centrifuge system wherein the condition information of the centrifuge indicates one of readiness, operating, and problem detected.

A centrifuge system wherein the condition information is indicated by a color coded field.

A centrifuge system wherein a red color coded field indicates a major problem.

A centrifuge system wherein a yellow color coded field indicates a minor problem.

A centrifuge system wherein selecting the color coded field activates displaying diagnostic information.

A method of performing a zonal centrifugation operation, the method comprising the steps of: a. indicating, on a screen of a centrifuge, that a loading step is the current step of the zonal centrifugation operation; b. delivering, while a zonal rotor is spinning, a sample onto a density gradient in the zonal rotor; and c. indicating, on the screen of the centrifuge after the loading step is complete, that a running step is the current step of the zonal centrifugation operation.

A method wherein indicating that the loading step is the current step includes highlighting a loading step-indicator.

A method wherein highlighting the loading step-indicator includes displaying a plurality of step-indicators, including the loading step-indicator.

A method wherein highlighting the loading step-indicator includes displaying the loading step-indicator in a different color than the other step-indicators of the plurality of step-indicators.

A method wherein highlighting the loading step-indicator includes displaying the loading step-indicator in one of a different background, foreground, border, intensity, and blink rate, than the other step-indicators of the plurality of step-indicators.

A method wherein the plurality of step-indicators includes step-indicators corresponding to each step of the zonal centrifugation operation.

A method wherein the plurality of step indicators includes a step-indicator corresponding to a loading step, a step-indicator corresponding to a running step, and a step indicator corresponding to an unloading step.

A method wherein indicating that the loading step is the current step includes displaying a single step-indicator on the screen, wherein the single step-indicator corresponds to the loading step.

A method further comprising displaying a load speed and a run speed on the screen during the loading step.

A method wherein the load speed is a preset rotational speed of the zonal rotor during the loading step of the zonal centrifugation operation, and wherein the run speed is a preset rotational speed of the zonal rotor during a running step of the zonal centrifugation operation.

A method further comprising displaying, on the screen, a help-statement that informs a user of a manual task necessary to complete the loading step.

A method wherein the help-statement informs the user to do one of: load density gradient; load sample; remove fill-head; install rotor cap; and press loading complete.

A method further comprising: displaying a loading-complete button on the screen of the centrifuge; and indicating, on the screen of the centrifuge, that the running step is the current step of the zonal centrifugation operation only after a user activates the loading-complete button.

A method wherein delivering the sample onto the density gradient includes delivering the sample while the zonal rotor is spinning at a rotational speed of approximately 2,000 to 3,000 RPM.

A method further comprising increasing the rotational speed of the zonal rotor to a run speed after the loading step is complete.

A method wherein the run speed is between about 10,000 and 35,000 RPM.

A centrifuge device for performing a zonal centrifugation operation, the centrifuge device comprising: a screen adapted to indicate the current step of the zonal centrifugation operation; a zonal rotor having a cavity, the zonal rotor configured to receive a sample onto a density gradient contained in the cavity; and a processor in communication with the screen, the processor adapted to control the rotation of the zonal rotor, the processor further adapted to display, on the screen, a step-indicator corresponding to the current step of the zonal centrifugation operation.

A centrifuge device for performing a first and second centrifugation operations, the centrifuge device comprising: a processor adapted to control the action of the centrifuge device during the first and second centrifugation operations based on the value of one or more centrifugation parameters; a local user interface communicatively connected to the processor, the local user interface adapted to receive values, entered by a local user, for one or more of the centrifugation parameters; and a remote user interface communicatively connected to the processor, the remote user interface adapted to receive values, entered by a remote user, for one or more of the centrifugation parameters, wherein, the processor is further adapted to limit the number of centrifugation parameters for which a remote user may enter a value to control the action of the centrifuge during the second centrifugation operation.

A centrifuge device wherein the processor is adapted to limit the number of centrifugation parameters for which a remote user may enter a value to control the action of the centrifuge, based on the current mode of operation of the centrifuge.

A centrifuge device wherein the current mode of operation is one of conventional mode of operation and rotor-accessible mode of operation.

A centrifuge device wherein the first centrifugation operation is a conventional centrifugation operation and wherein the second centrifugation operation is a zonal centrifugation operation.

A centrifuge device wherein the processor is adapted to limit the number of centrifugation parameters for which a remote user may enter by preventing the remote user from entering a rotor speed for a step of the zonal centrifugation operation.

A centrifuge device wherein the rotor speed of a zonal rotor is one of load speed and run speed.

A centrifuge device further comprising a network connection communicatively connecting the processor to the remote user interface, wherein the processor is adapted to disable the network connection before performing the second centrifugation operation.

A centrifuge device wherein the remote user interface includes a remote screen adapted to display the values of one or more of the centrifugation parameters.

A centrifuge device wherein the remote screen is adapted to display the values of one or more centrifugation parameters entered by the local user.

A centrifuge device wherein the processor is further adapted to display, on the remote screen, a step-indicator corresponding to the current step of a zonal centrifugation operation.

A centrifuge system comprising: a local user interface adapted to receive commands entered by a user to control the action of a centrifuge; a remote device including a remote user interface, the remote user interface adapted to receive commands entered by a user to control the action of the centrifuge; and a processor adapted to limit the control of the action of the centrifuge from the remote device based on a mode of operation of the centrifuge.

A centrifuge system wherein the processor is adapted to limit the control of the operation of the centrifuge from the remote device if the centrifuge is in a rotor-accessible mode of operation.

A centrifuge system wherein a zonal centrifugation operation can only be performed in the rotor-accessible mode of operation.

A centrifuge system wherein the processor is adapted to disallow entry, into the remote user interface, of a command controlling a rotor speed of the centrifuge during the zonal centrifugation mode of operation.

A method further comprising the step of indicating, on a screen of a remote device in communication with the centrifuge, that the loading step is the current step of the zonal centrifugation operation.

A method further comprising the step of limiting the ability of a user to control the centrifuge from a remote location during the zonal centrifugation operation.

A centrifuge device wherein the processor is further adapted to prompt a user to make a selection between a conventional and a rotor-accessible mode of operation.

A centrifuge device further comprising a remote mobile device communicatively connected to the processor, the remote mobile device adapted to display a centrifuge parameter of the centrifuge.

A centrifuge device wherein the processor is further adapted to communicatively disconnect the remote mobile device from the processor during the zonal centrifugation operation.

A centrifuge device wherein the zonal centrifugation operation includes the steps of loading, running, and unloading, wherein the processor is further adapted to generate an audible alarm at a predetermined time before the end of the running step to notify a user of the end of the running step.

A method of operating a centrifuge, the method comprising: a. displaying a workflow diagram of a centrifuge operation, the workflow diagram including a step-indicator of loading sample into a zonal rotor; b. loading sample into a rotor while the rotor is spinning at a first speed; c. indicating completion of the step of loading sample; and d. increasing rotor spinning speed to a second speed.

A method wherein the rotor is disposed in a chamber and a door covering an access to the rotor is disposed about the chamber, the door automatically locks to prevent user access to the rotor before the step of increasing rotor spinning speed to the second speed.

A method further including the step of applying vacuum in the chamber after the door is automatically locked.

A method wherein the first speed is between 2,000 rpm and 3,000 rpm.

A method wherein the second speed is between 10,000 and 32,000 rpm.

A method wherein the first speed is 3,000 rpm maximum.

A method wherein the first speed and second speed is preset by the user.

A method wherein an alert is activated during the step of loading sample into the rotor while the rotor is spinning at a first speed.

A method wherein the alert is an audio alert.

A method wherein when the door is open while the rotor is spinning, an alert is activated.

A method wherein the step-indicator of loading sample is highlighted during the step of loading sample into a rotor while the rotor is spinning at a first speed.

A method wherein the step-indicator is highlighted by illumination.

A method of operating a centrifuge, the method comprising: displaying a workflow diagram of a centrifuge operation, the workflow diagram including a loading step-indicator, a running step-indicator, and an unloading step-indicator; loading sample into a rotor while the loading step-indicator is highlighted and while the rotor is spinning at a first speed; spinning the rotor at a second speed while the running step-indicator is highlighted; and unloading sample from the rotor while the unloading step-indicator is highlighted and while the rotor is spinning at a third speed.

A method wherein the first speed and the second speed are the same speed.

A method wherein the rotor is disposed in a chamber, the chamber including an access door, the step of loading sample into the rotor includes having the access door open while the rotor is spinning.

A method wherein the step of loading sample includes a manual operation performed by a user.

A method wherein an audio alert is activated while the access door is open and the rotor is spinning.

A method wherein the rotor is disposed in a chamber, the chamber including an access door, the step of spinning the rotor at a second speed includes having the access door locked while the rotor is spinning at the second speed.

A method wherein the rotor is disposed in a chamber, the chamber including an access door, the step of unloading sample from the rotor includes having the access door open while the rotor is spinning at the third speed.

A method wherein the first speed and the third speed are 3,000 rpm maximum.

A method wherein the step-indicators are individually highlighted by one of illumination, color differentiation, and blink rate.

A method wherein the workflow diagram includes step-indicators corresponding to steps of a zonal centrifugation.

A method wherein the step of spinning the rotor at a second speed is performed under a vacuum.

A remote access centrifuge comprising: a first centrifuge including a rotor, a chamber, and a monitor, the rotor disposed in the chamber, the monitor configured to display a status indication and a notice indication; and a handheld device communicatively coupled to the first centrifuge, the handheld device including a screen configured to display the status indication and the notice indication of the first centrifuge.

A method wherein the first centrifuge and the handheld device are communicatively coupled over the internet.

A method wherein the handheld device is adapted to activate an alarm if the status indication changes.

A method further comprising a second centrifuge including a second monitor, the second monitor configured to display a second status indication and a second notice indication.

A method wherein the screen is further configured to display the second status indication and the second notice indication of the second centrifuge.

A method wherein the status indication includes green for normal and red for a malfunction.

A method wherein the screen is further configured to display preset centrifugation parameters and actual centrifugation parameters.

A method wherein the handheld device is able to set the centrifugation parameters for a conventional centrifugation operation.

A method wherein the handheld device is unable to set the centrifugation parameters for a zonal centrifugation operation.

A method wherein the screen is further configured to display a diagnostic message if the status indication is malfunction.

The various embodiments described in this specification are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A method of operating a zonal centrifuge, the method comprising:

generating a user interface displaying a workflow diagram of a centrifuge operation, the workflow diagram including at least a loading step-indicator, a running step-indicator, and an unloading step-indicator;

receiving sample into a rotor of the centrifuge device during a loading step while the loading step-indicator is highlighted and while the rotor is running at a first speed;

receiving input at a processing device from a user using an input interface device indicating the sample has been received into the rotor;

spinning the rotor at a second speed during a running step while the running step-indicator is highlighted;

unloading sample from the rotor during an unloading step while the unloading step-indicator is highlighted and while the rotor is spinning at a third speed;

receiving input at a processing device from the user using an input interface device indicating the sample has been unloaded from the rotor, wherein the rotor spins during each of the loading step, the running step, and the unloading step.

2. The method of claim 1, wherein highlighting involves one of: illuminating, color differentiating, and blink rate variation.

3. The method of claim 1, wherein the rotor is disposed in a chamber, the chamber including an access door, and wherein receiving sample into the rotor includes having the access door open while the rotor is spinning.

4. The method of claim 3, wherein during receipt of the sample into the rotor, the user manually loads the sample into the rotor.

5. The method of claim 3, further comprising activating an audible alert while the access door is open and the rotor is spinning.

6. The method of claim 1, wherein the rotor is disposed in a chamber, the chamber including an access door, and wherein the step of spinning the rotor at a second speed includes having the access door locked while the rotor is spinning at the second speed, wherein the second speed is greater than the first speed.

7. The method of claim 1, wherein the rotor is disposed in a chamber, the chamber including an access door, and wherein unloading sample from the rotor includes having the access door open while the rotor is spinning at the third speed.

8. The method of claim 1, wherein the first speed and the third speed are less than or equal to 3,000 rpm.

9. The method of claim 1, wherein the spinning the rotor at a second speed is performed under a vacuum.

10. A centrifuge system for performing zonal centrifugation operation, the centrifuge system comprising a centrifuge device comprising:

a zonal rotor having a cavity, the zonal rotor configured to receive a sample onto a density gradient contained in the cavity;

a display device adapted to display a user interface; and a processing device adapted to:

control a rotation of the zonal rotor to operate the zonal rotor in a loading mode where the sample is loaded onto the density gradient, a running mode, and an unloading mode where a separated sample is unloaded from the zonal rotor, wherein the control of the zonal rotor causes the zonal rotor to spin in each of the loading mode, the running mode, and the unloading mode;

generate the user interface with the display device, the user interface displaying a loading step-indicator when the zonal operator is operating in the loading mode, a running step-indicator when the zonal rotor is operating in the running mode, and an unloading-step indicator when the zonal rotor is operating in the unloading mode; and receive an input from a user indicating the sample is loaded.

11. The centrifuge system of claim 10, wherein the rotor operates at a first speed when operating in the loading mode and a second speed when operating in the running mode, wherein the second speed is greater than the first speed.

12. The method of claim 1 further comprising displaying a help-statement during the loading step.

13. The centrifuge system of claim 10, wherein the processing device is adapted to receive an input from the user indicating the sample is unloaded.

14. The centrifuge system of claim 10, wherein the user interface is configured to display a loading-complete button.

15. The centrifuge system of claim 10, wherein the user interface is configured to display an unloading-complete button.

16. The centrifuge system of claim 10, wherein the user interface is configured to display a help-statement while the zonal rotor operates in loading mode.

17. The centrifuge system of claim 16, wherein the help-statement informs the user to load the sample.

18. The centrifuge system of claim 16, wherein the help-statement informs the user to load the density gradient.

19. The centrifuge system of claim 10, wherein the user interface is configured to display a preset load speed that may not exceed 3000 RPM.

20. The centrifuge system of claim 10, wherein the user interface is configured to display a preset unload speed that may not exceed 3000 RPM.

* * * * *